US009551536B2

(12) United States Patent
Yamazaki

(10) Patent No.: US 9,551,536 B2
(45) Date of Patent: Jan. 24, 2017

(54) HEAT EXCHANGER WITH RECEIVER TANK

(75) Inventor: Makoto Yamazaki, Saitama (JP)

(73) Assignee: CALSONIC KANSEI CORPORATION, Saitama-Shi (JP)

( * ) Notice: Subject to any disclaimer, the term of this patent is extended or adjusted under 35 U.S.C. 154(b) by 1164 days.

(21) Appl. No.: 13/121,543

(22) PCT Filed: Sep. 25, 2009

(86) PCT No.: PCT/JP2009/066632
§ 371 (c)(1),
(2), (4) Date: Mar. 29, 2011

(87) PCT Pub. No.: WO2010/038672
PCT Pub. Date: Apr. 8, 2010

(65) Prior Publication Data

US 2011/0272130 A1 Nov. 10, 2011

(30) Foreign Application Priority Data

Sep. 30, 2008 (JP) ..... 2008-255029
Oct. 1, 2008 (JP) ..... 2008-256101

(51) Int. Cl.

| | |
|---|---|
| ***F28D 1/06*** | (2006.01) |
| ***F28D 1/00*** | (2006.01) |
| ***F28D 7/10*** | (2006.01) |
| ***F28D 1/053*** | (2006.01) |
| ***F28F 9/00*** | (2006.01) |
| *F28F 9/02* | (2006.01) |

(52) U.S. Cl.
CPC ..... *F28D 1/05375* (2013.01); *F28F 9/002* (2013.01); *F28F 9/0251* (2013.01); *F25B 2339/0442* (2013.01); *F28F 9/0224* (2013.01); *F28F 2275/122* (2013.01)

(58) Field of Classification Search
CPC ..... F28F 9/001; F28F 9/002; F28F 9/0024; F25B 39/04; F28D 1/0341; F28D 7/106
USPC ..... 165/185, 132, 149, 154, 153, 176, 174, 165/175
See application file for complete search history.

(56) References Cited

U.S. PATENT DOCUMENTS

| | | | | |
|---|---|---|---|---|
| 5,901,573 | A * | 5/1999 | Kobayashi | 62/507 |
| 6,052,899 | A * | 4/2000 | Inaba | 29/890.043 |
| 6,293,011 | B1 * | 9/2001 | Hasegawa | B23K 1/0012 165/173 |
| 2003/0085026 | A1 * | 5/2003 | Kaspar et al. | 165/132 |

(Continued)

FOREIGN PATENT DOCUMENTS

| | | | |
|---|---|---|---|
| JP | 04-121562 | A | 4/1992 |
| JP | 08-296991 | A | 11/1996 |

(Continued)

*Primary Examiner* — Len Tran
*Assistant Examiner* — Claire Rojohn, III
(74) *Attorney, Agent, or Firm* — Foley & Lardner LLP

(57) ABSTRACT

In a heat exchanger 1 provided with a receiver tank 9 where a tank 3 of the heat exchanger 1 are connected with each other through intermediate member 7, 8, at least one side of the intermediate member 7, 8 and an outer circumferential portion of the receiver tank 9 is provided with a restricting portion 13*c*, 31 that restricts a relative displacement between the intermediate members 7, 8 and the receiver tank 9 in a direction along an attachment surface of the receiver tank 9 to which at least the intermediate member 7, 8 is attached.

20 Claims, 33 Drawing Sheets

(56) References Cited

U.S. PATENT DOCUMENTS

| | | | | |
|---|---|---|---|---|
| 2004/0182553 | A1* | 9/2004 | Seno | F25B 39/04 165/132 |
| 2006/0123837 | A1* | 6/2006 | Shah | F25B 39/04 62/509 |
| 2007/0062215 | A1* | 3/2007 | Yamazaki | F28D 1/05366 62/509 |
| 2011/0198065 | A1* | 8/2011 | Hanafusa | F25B 39/04 165/173 |

FOREIGN PATENT DOCUMENTS

| | | | |
|---|---|---|---|
| JP | 09-217967 | A | 8/1997 |
| JP | 10-002692 | A | 1/1998 |
| JP | 2006-250450 | A | 9/2006 |
| JP | 2007-113792 | A | 5/2007 |
| JP | 2007-285547 | A | 11/2007 |

* cited by examiner

HEAT EXCHANGER WITH RECEIVER TANK

TECHNICAL FIELD

The present invention relates to a heat exchanger with a receiver tank which is adapted for a motor vehicle or the like.

BACKGROUND OF THE INVENTION

A technology of a heat exchanger with a receiver tank is described in patent document 1 listed below.

In such a heat exchanger with a receiver tank, the receiver tank and a tank of the heat exchanger are communicatably connected with each other in a state where they are positioned.

[Patent Document 1] Patent application laid-open No. 2006-250450

DISCLOSURE OF THE INVENTION

Problem(s) to be Solved by the Invention

However, in the prior invention, in a case where a connecting portion of an intermediate member is temporally fixed in a state where the connecting portion is inserted in the receiver tank, a tip portion of the inserted connecting portion easily projects inward of the interior of the receiver tank to closely approach to or contact with a constructional member (such as a filter) that is arranged in the interior thereof. This causes a problem in that design freedom of the interior of the receiver tank is limited.

In order to avoid the above-described problem, adapting a construction where the connecting portion of the intermediate member contacts with an outer circumferential portion of the receiver tank, it might complicate a jig to temporally fix the both members in a state where they are positioned in a brazing process thereof.

The invention is made to resolve the above-mentioned problems, and its object is to provide a heat exchanger with a receiver tank in which an intermediate member does not project in the interior of the receiver tank and the intermediate member and the receiver tank can be fixed with each other in a state where they are easily and properly positioned.

DISCLOSURE OF THE INVENTION

Means for Solving the Problems

In the present invention, there is provided a heat exchanger with a receiver tank in which a tank of the heat exchanger and the receiver tank are connected with each other through an intermediate member that communicates the tank of the heat exchanger and the receiver tank, the heat exchanger being characterized in that at least one side of the intermediate member and an outer circumferential portion of the receiver tank is provided with a restricting portion that restricts a relative displacement between the intermediate member and the receiver tank at the outer circumferential portion of the receiver tank in a direction along an attachment surface of the receiver tank to which at least the intermediate member is attached.

Effect of the Invention

This enables the restricting portion to restrict the relative displacement between the intermediate member and the receiver tank in one direction of a lateral direction and a lateral direction of a motor vehicle without the intermediate member being inserted in the interior of the receiver tank. Therefore, there is no possibility of the intermediate member being in close vicinity of and in contact with a construction member contained in the receiver tank, which can increase design freedom of the interior of the receiver tank. In addition, it can improve joint quality in a brazing process of the receiver tank and the intermediate member, thereby improving its product reliability.

DESCRIPTION OF REFERENCE NUMBERS

Figure 1:
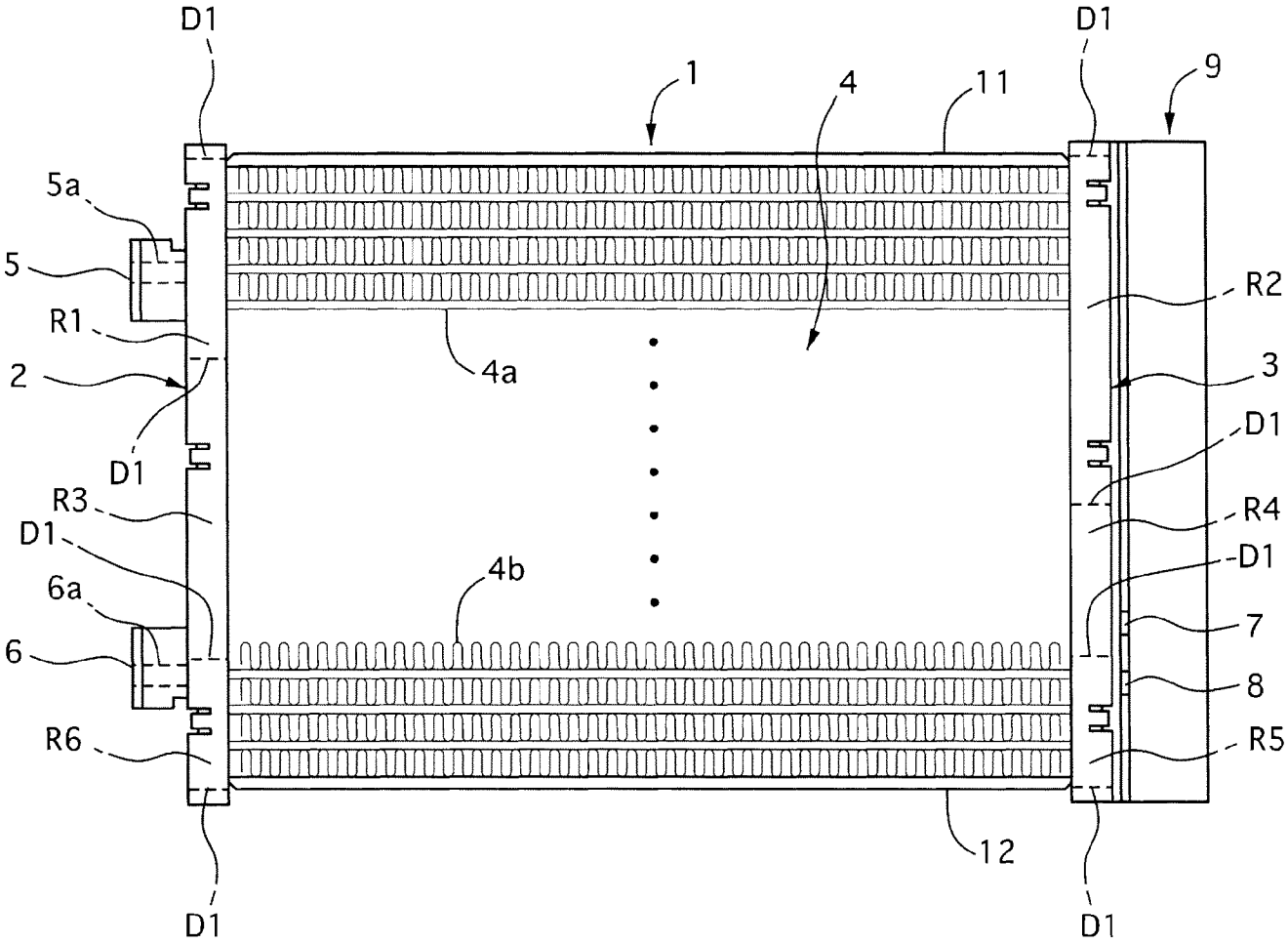
FIG. 1 is a front view showing a condenser with a receiver tank of a first embodiment.

D1 divide plate
R1, R2, R3, R4, R5, R6, P1, P2 chamber
1 condenser
2, 3 tank
4 core part
4*a* tube
4*b* fin
5 input connector
5*a* input port
6 output connector
6*a* output port
7, 8 intermediate member
7*a*, 8*a* communicating hole
7*b*, 8*b* inserting portion
7*c*, 8*c* seat portion
7*d*, 8*d* contact surface
7*e*, 8*e* intermediate portion
9 receiver tank
9*a* outer circumferential portion
10*a* tube plate
10*b* tank plate
10*c* reinforcement hole
10*d* tube hole
10*e* bead
10*f* latching portion
10*g* projecting portion
10*h* fixing hole
10*i*, 10*j*, 10*k*, 10*m* communicating hole
11, 12 reinforcement
13 tank main body
13*a* side wall
13*b* bottom portion
13*c* restricting portion
13*d*, 13*e* communicating hole
13*f* caulking portion
14*a*, 14*b* cap member
14*c* outer circumferential portion
15 metallic filter
16 filter main body portion
16*a* opening end portion
17 flange portion
17*a* upper end portion
17*b* lower end portion
17*c* enlarged diameter portion
18 metallic ring
19 bracket portion
20*a* brazing filler material
21 connecting portion
22 fixing portion
22*a* both side wall (restricting portion)
30 fitting portion
31 restricting portion
32 fixing portion
60 claw portion
70 holding member
90 metallic filter

BEST MODE FOR CARRYING OUT THE INVENTION

Hereinafter, embodiments according to the present invention will be described with reference to the accompanying drawings.

First Embodiment

Hereinafter, a first embodiment will be described.

Figure 2:
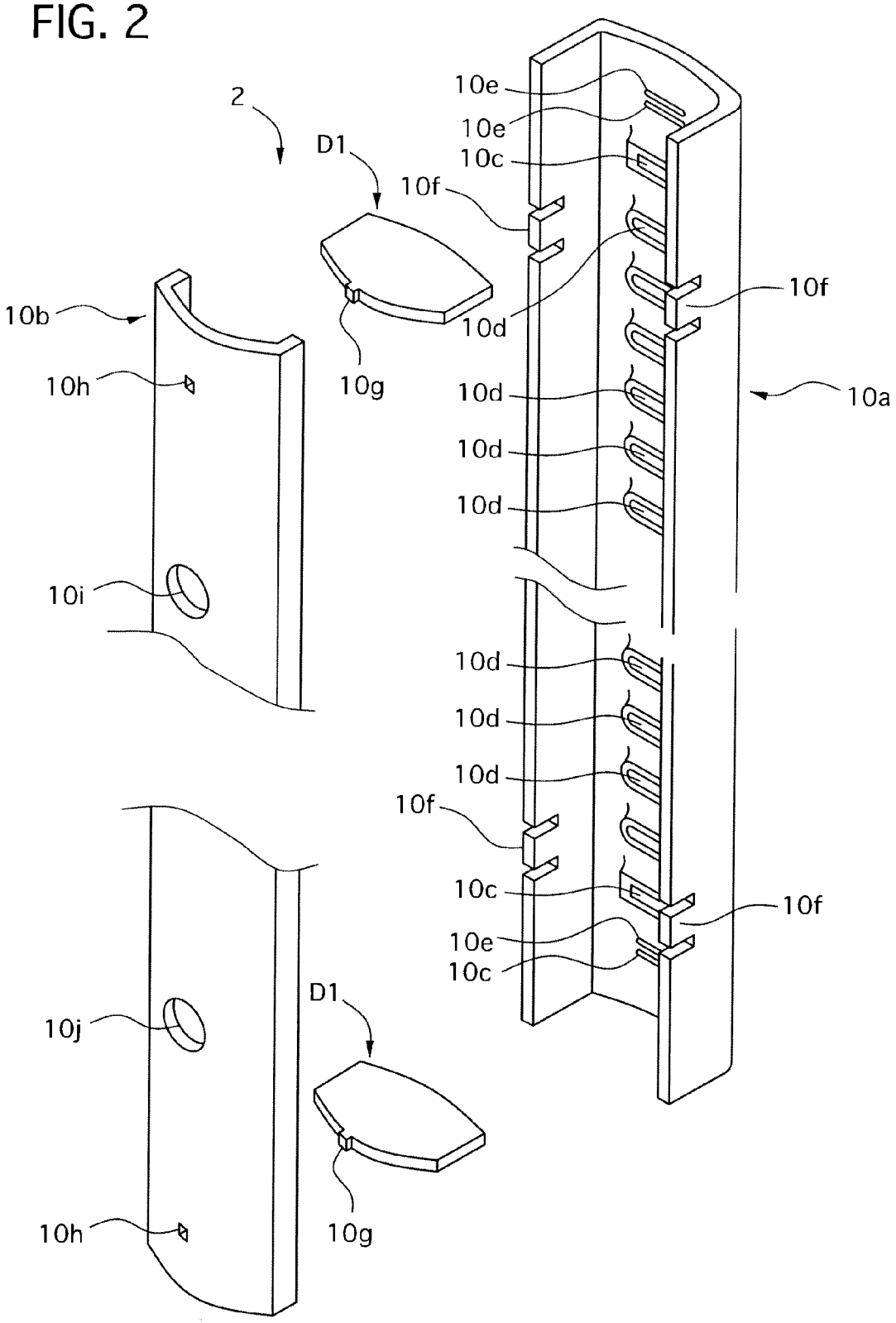
FIG. 2 is an exploded perspective view of one of tanks of the condenser shown in FIG. 1.
Figure 3:
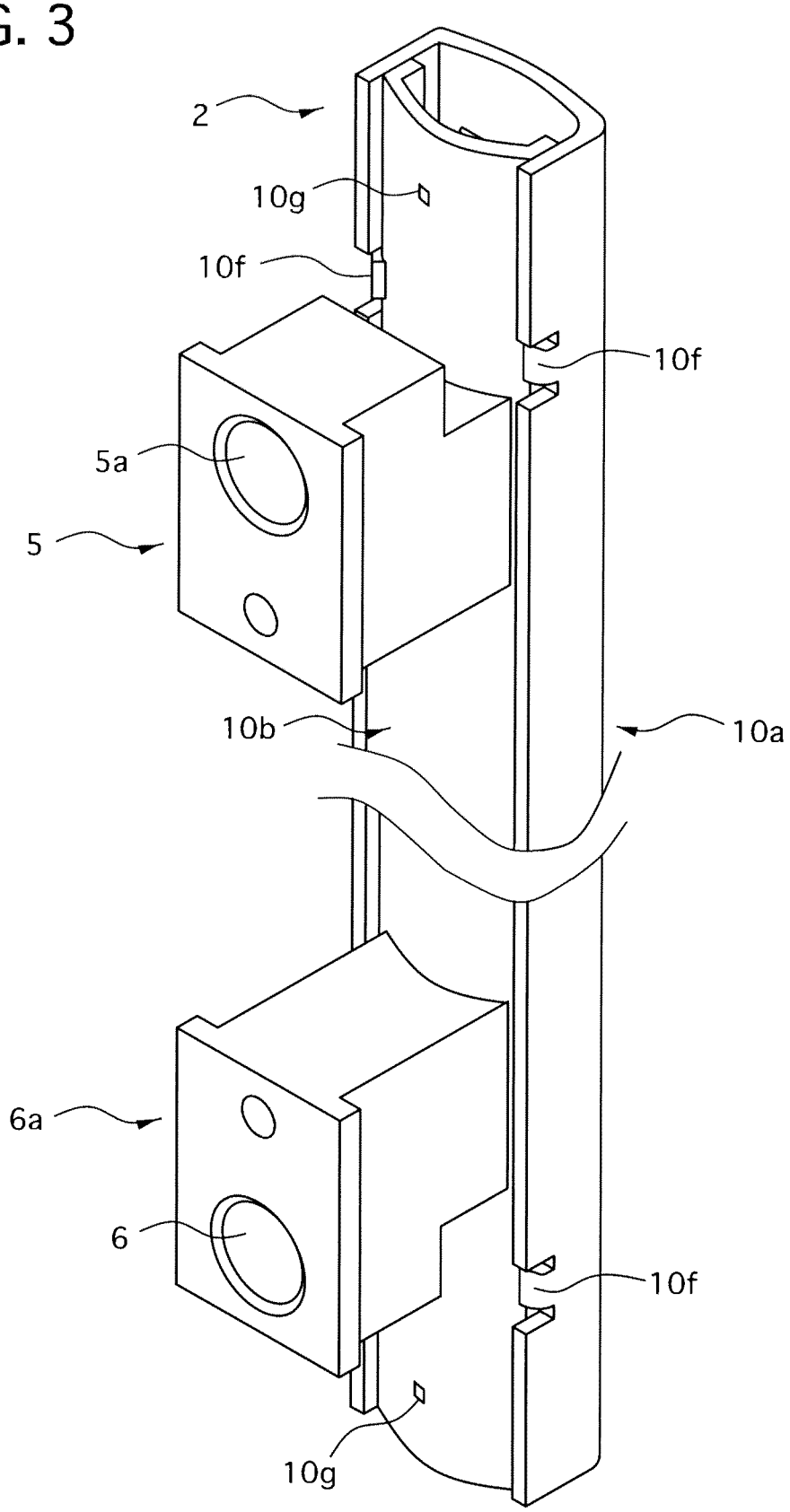
FIG. 3 is a perspective view of the tank shown in FIG. 2 and intermediate members.
Figure 4:
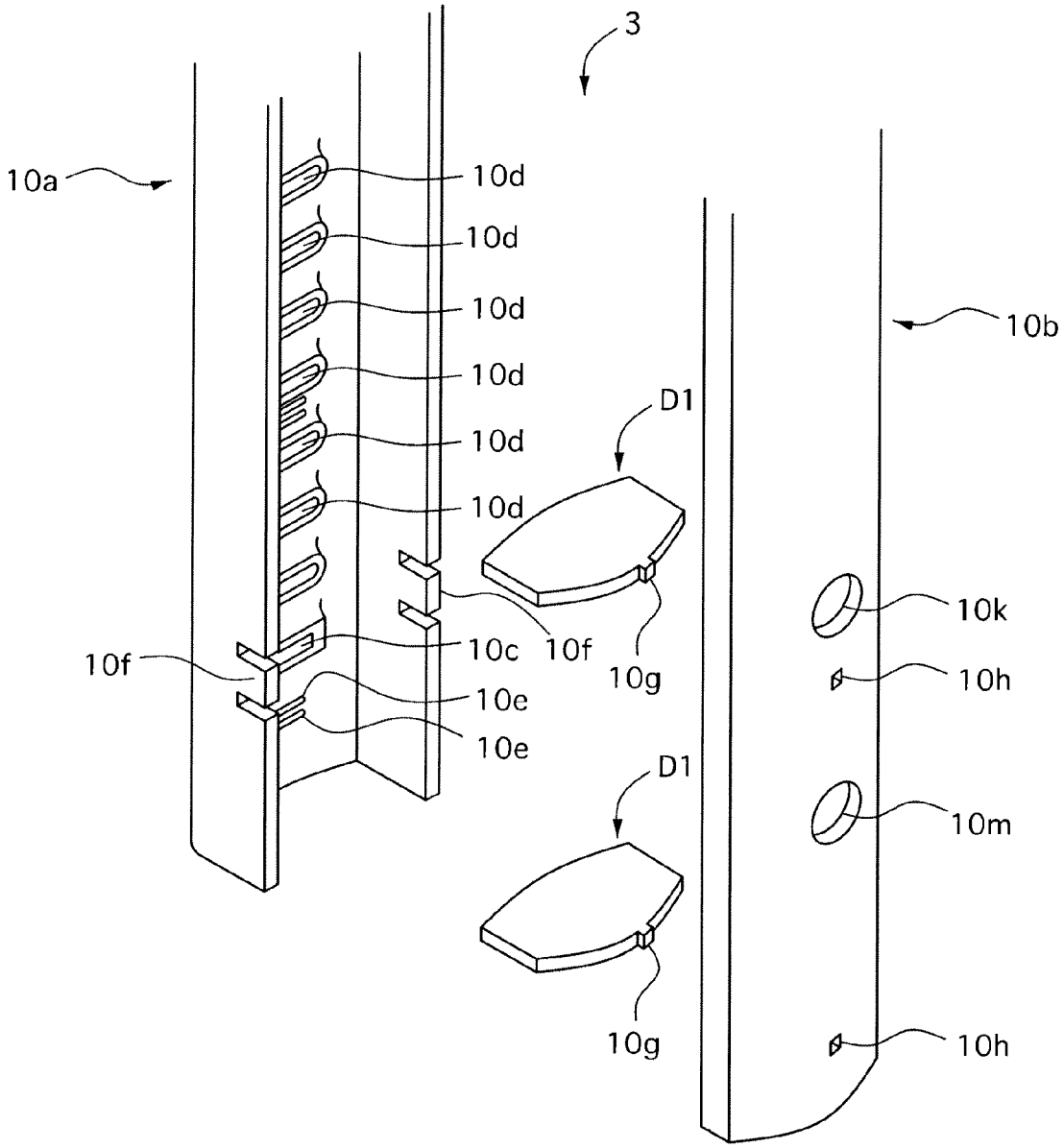
FIG. 4 is an exploded perspective view of the other tank to which the receiver tank of the first embodiment is attached.
Figure 5:
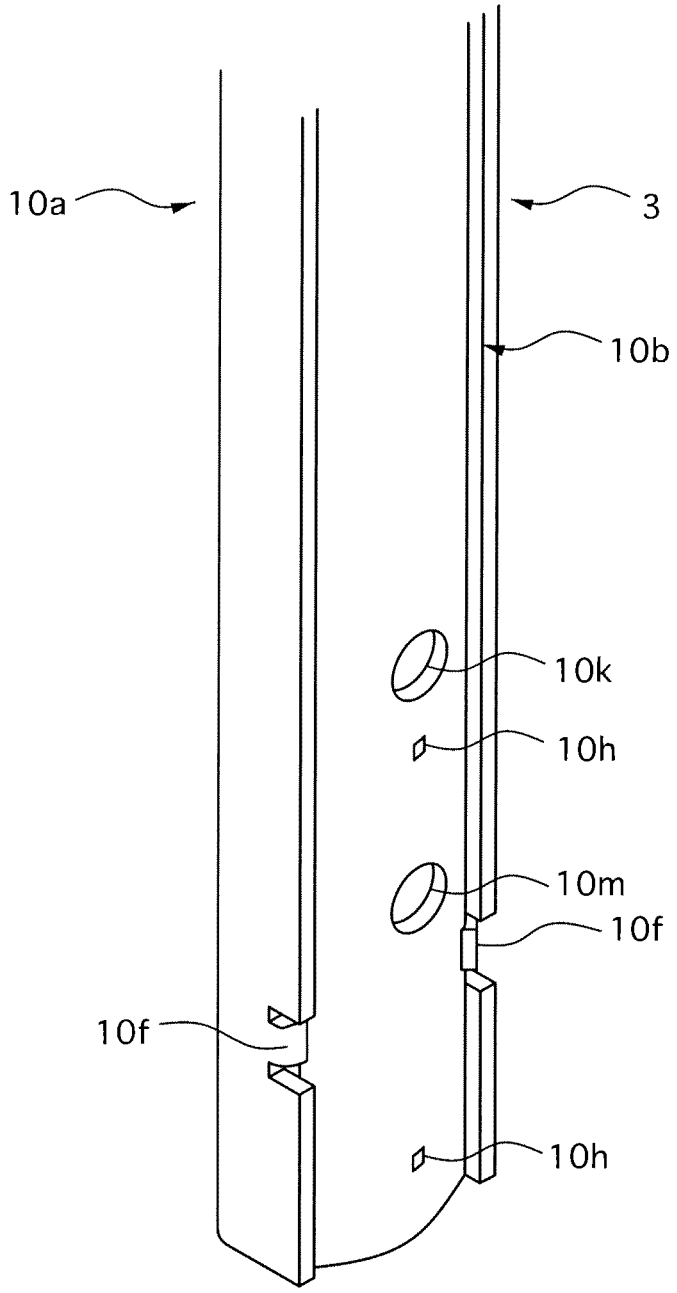
FIG. 5 is a perspective view of the other tank shown in FIG. 4.
Figure 6:
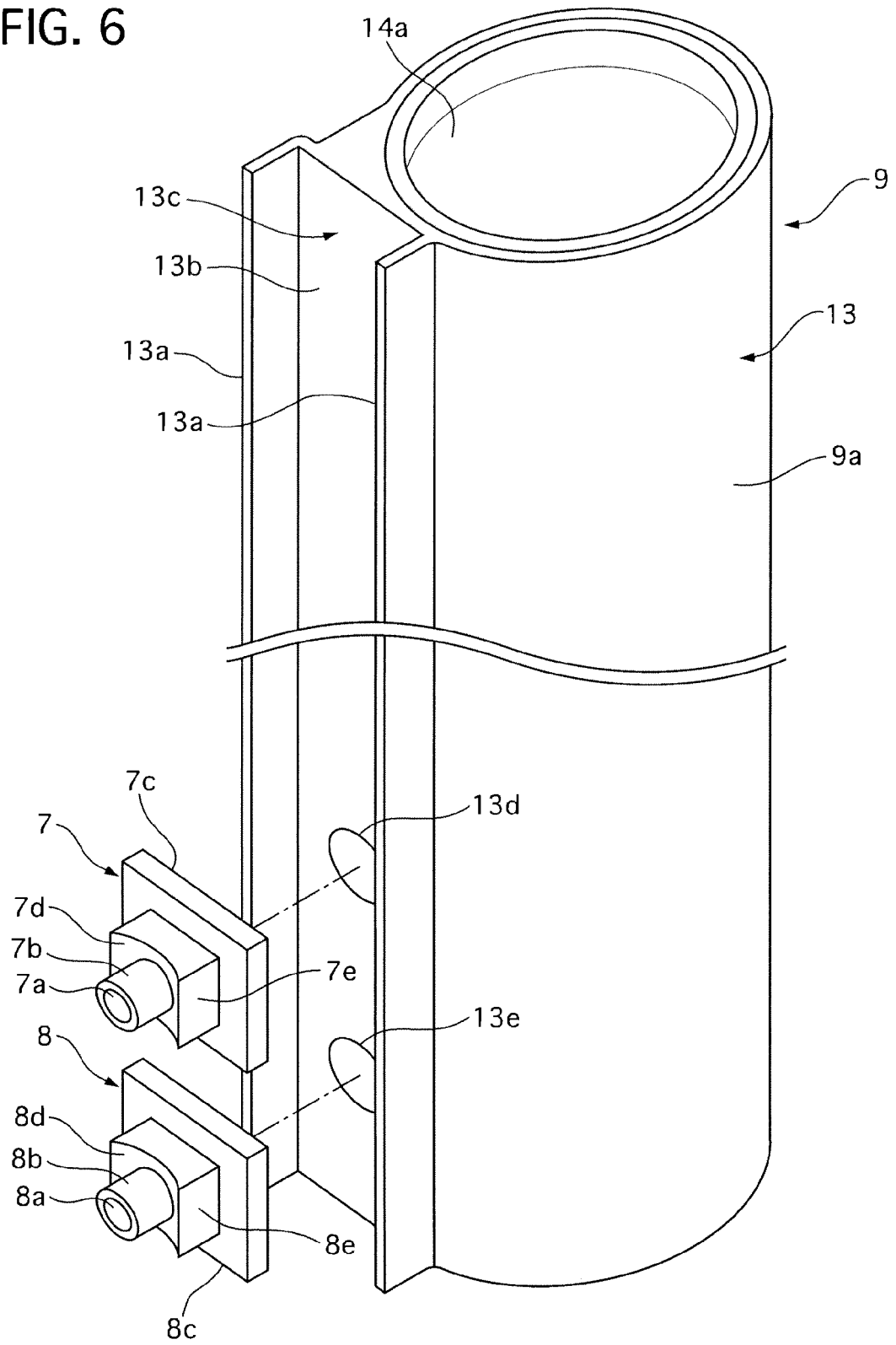
FIG. 6 is an exploded perspective view of the receiver tank and the intermediate members of the first embodiment.

FIG. 1 is a front view showing a condenser with a receiver tank of the first embodiment, FIG. 2 is an exploded perspective view showing one of tanks of the condenser, FIG. 3 is a perspective view of the same, FIG. 4 is an exploded perspective view of the other tank of the condenser, FIG. 5 is a perspective view of the same, and FIG. 6 is an exploded perspective view of an intermediate member and the receiver tank that are used in the first embodiment.

Figure 7:
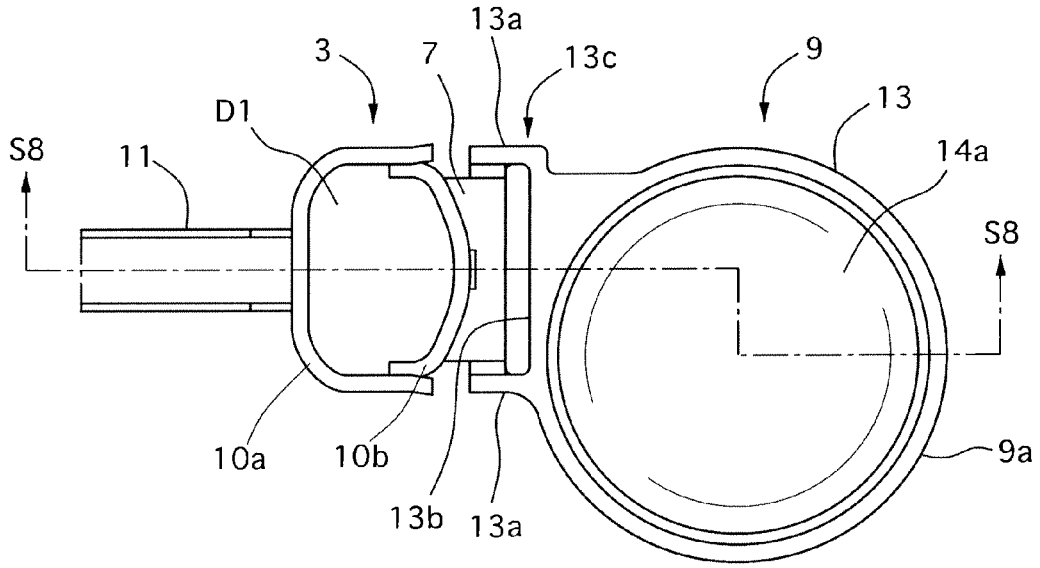
FIG. 7 is a top view of the receiver tank and its neighboring parts of the first embodiment.
Figure 8:
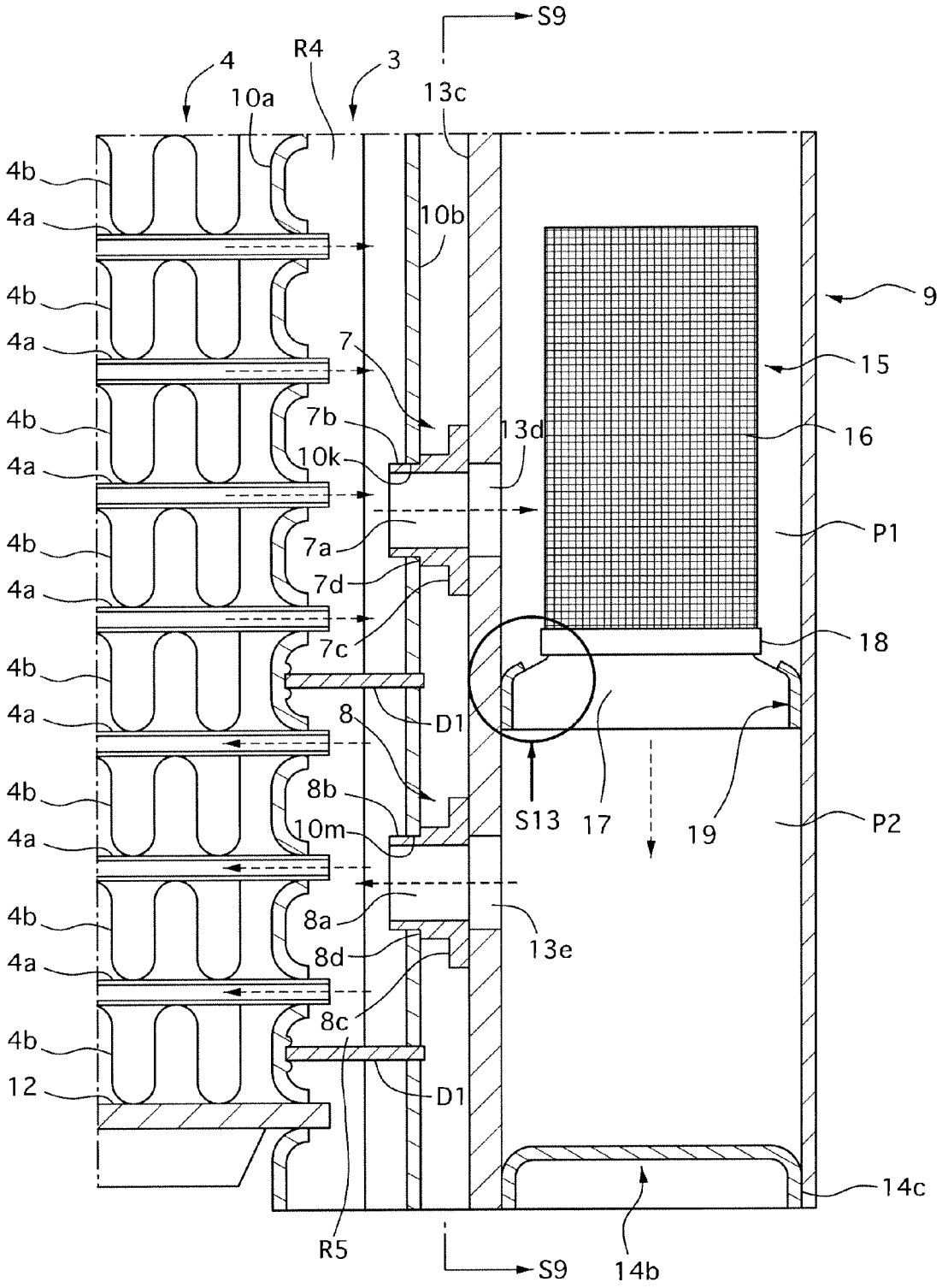
FIG. 8 is a cross sectional view taken along the line S8-S8 in FIG. 7.
Figure 9:
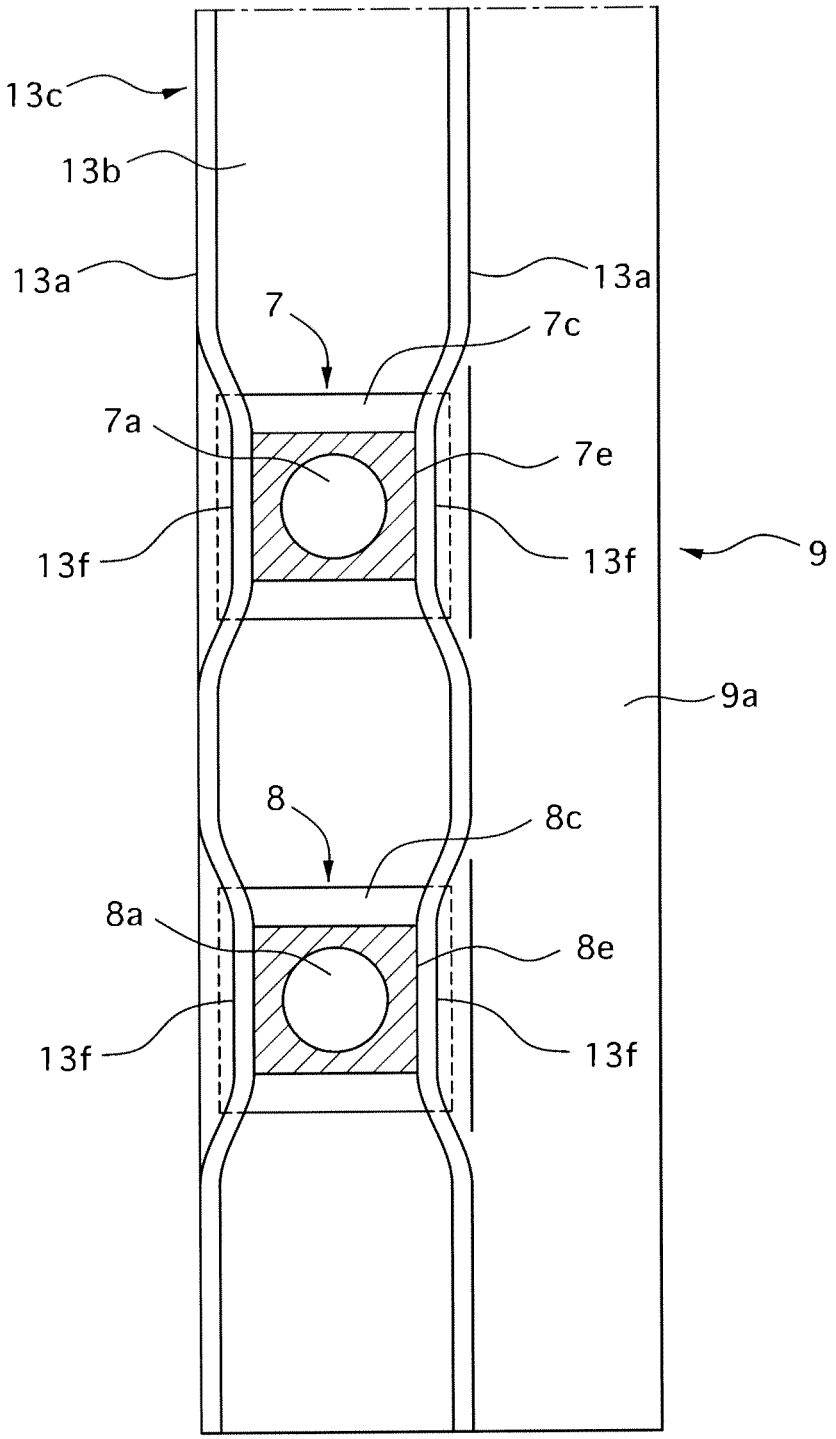
FIG. 9 is a cross sectional cross view taken along the line S9-S9 in FIG. 8.

FIG. 7 is a top view of the receiver tank and its neighboring parts that are used in the first embodiment, FIG. 8 is a cross sectional view taken along the line S8-S8 in FIG. 7, and FIG. 9 is a cross sectional view taken along the line S9-S9 in FIG. 8.

Figure 10:
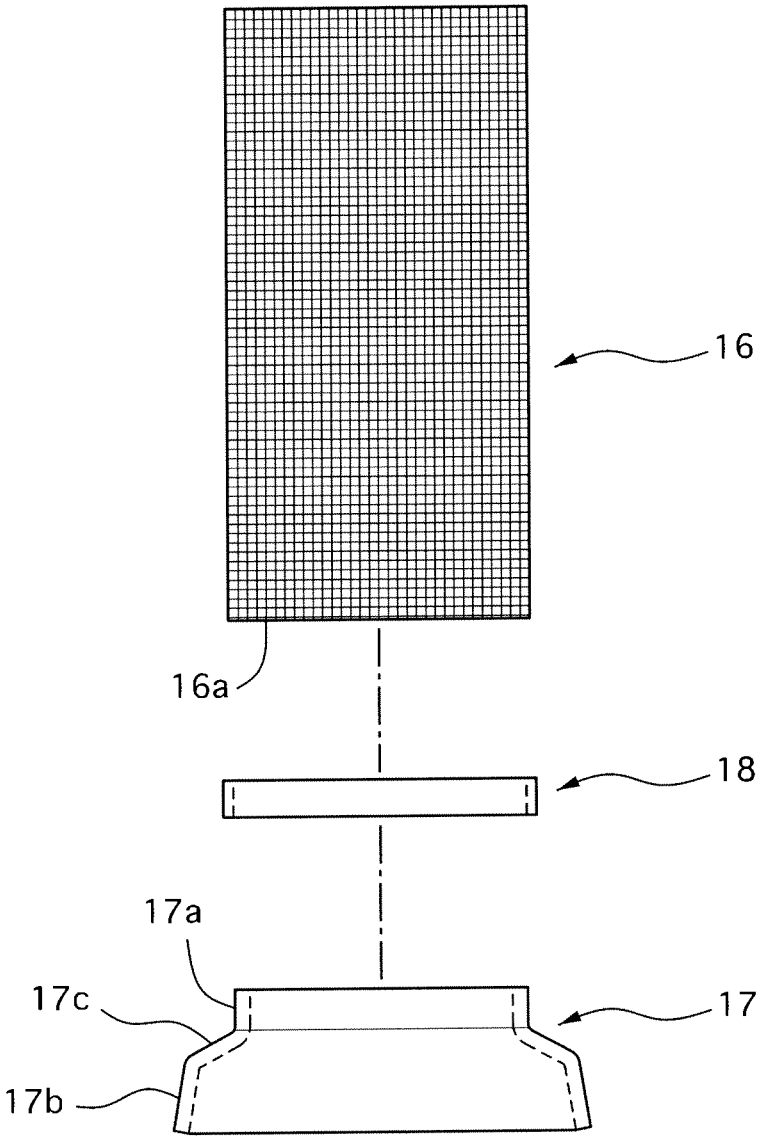
FIG. 10 is an exploded front view of a metallic filter that is used for the receiver tank of the first embodiment.
Figure 11:
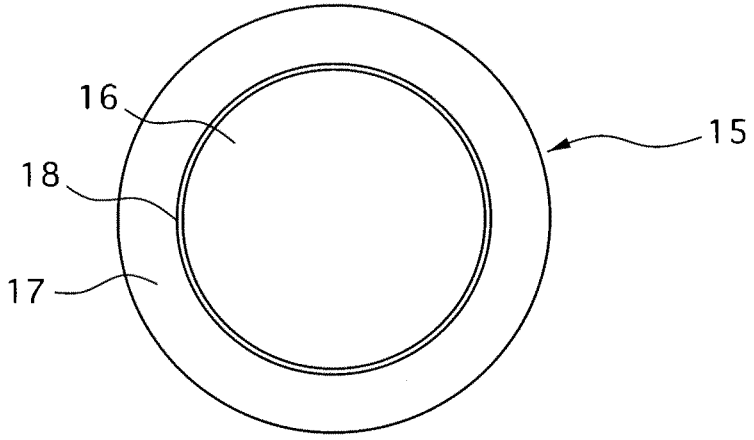
FIG. 11 is a top view of the metallic filter shown in FIG. 10.
Figure 12:
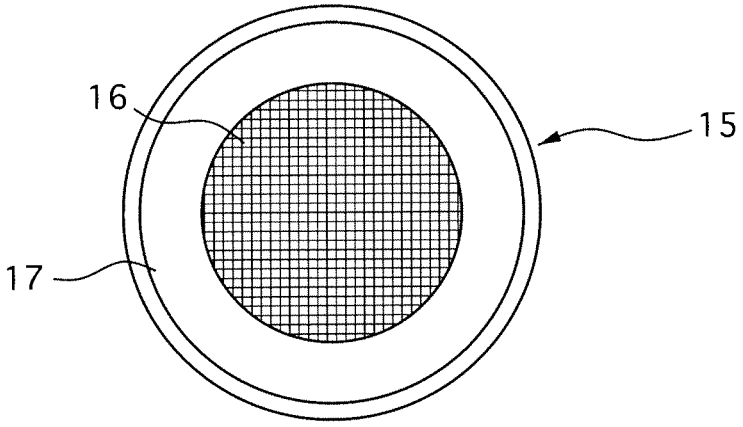
FIG. 12 is a bottom view of the metallic filter shown in FIG. 10.
Figure 13:
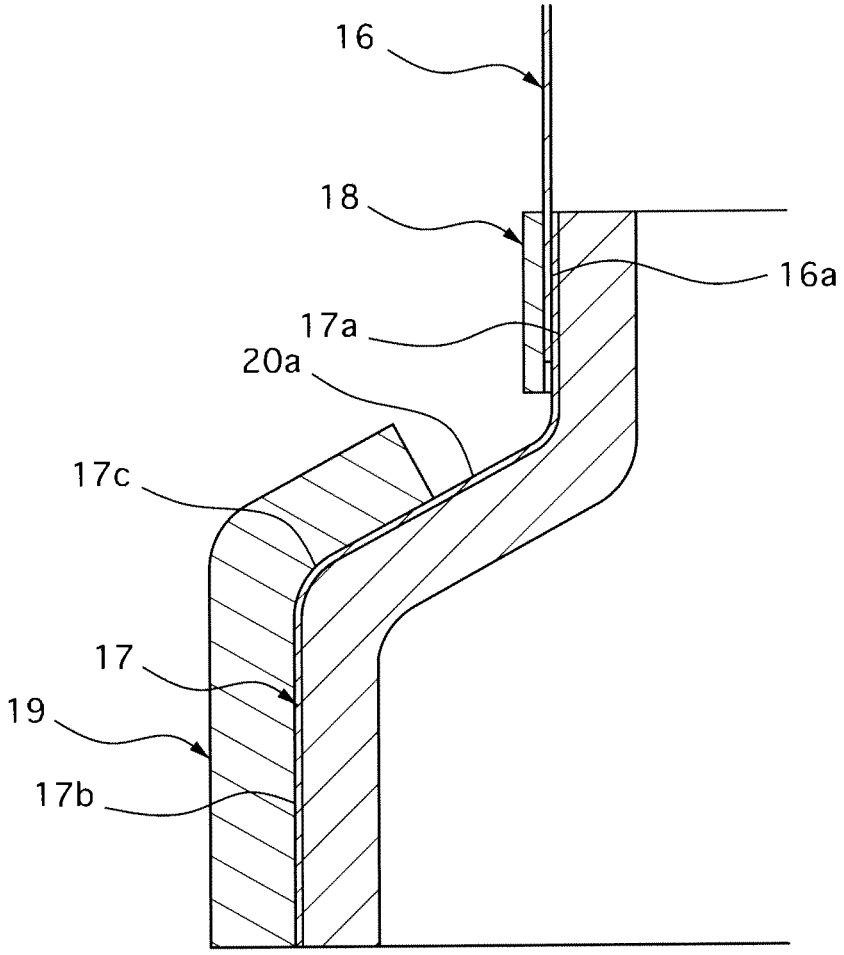
FIG. 13 is an enlarged cross sectional view of a part in a circle that is indicated by an arrow S13 in FIG. 8.

FIG. 10 is an exploded view of a metallic filter of the first embodiment, FIG. 11 is a top view of the metallic filter of the first embodiment, FIG. 12 is a bottom view of the same, and FIG. 13 is an enlarged cross sectional view of the vicinity part that is indicated by an arrow S13 in FIG. 8.

First, the entire construction of a condenser 1 provided with a receiver tank 9 will be described.

As shown in FIG. 1, the condenser 1 provided with the receiver tank 9 of the first embodiment has a pair of tanks 2, 3 that are arranged a predetermined distance apart from each other in a left and right direction, a core part 4 that is arranged between the both tanks 2, 3, and others.

The tank 2 has three chambers R1, R3, R6 that are divided by using four divided plates D1, and it is provided with an input connector 5 having an input port 5*a* that communicates with the first chamber R1, and an output connector 6 having an output port 6*a* that communicates with the sixth chamber R6.

The tank 3 has three chambers R2, R4, R5 that are divided by using four divided plates D1, and it is provided with the receiver tank 9 that communicates with the fourth chamber R4 and the fifth chamber R5 through the intermediate members 7, 8.

As shown in FIG. 2, the tank 2 includes a tube plate 10*a* that is formed like a half-tube having a cross section shaped like a U-letter, a tank plate 10*b* that is formed like a half-tube having a cross section shaped like a U-letter to be coupled with the tube plate 10*a*, and the divided plates D1 that are disposed inside the both plates 10*a*, 10*b*.

The tube plate 10 is formed with reinforcement holes 10*c* and tube holes 10*d*, which are formed by using a burring process to have a tubular portion that projects inside, where the reinforcement holes 10*c* are inserted so as to be fixed therein by end portions of reinforcements 11, 12 shown in FIG. 1, and the tube holes 10*d* are inserted to be fixed therein by end portions of the tubes 4*a*.

In addition, pairs of beads 10*e* are formed to project inside to fix core-part side portions of the divided plates D1 in a state where the beads 10*e* sandwich the core-part side portions at the positions of the tube plate 10*a* to fix the divide plates D1.

Further, a plurality of pairs of engagement portions 10*f* shaped like a claw are formed along a longitudinal direction of the tube plate 10*a* on facing side walls of the tube plate 10*a* having the U-letter shaped cross section, where the engagement portions 10*f* are fixable by caulking on a portion of an external circumferential portion of the tank plate 10*b*.

Incidentally, the configurations, the numbers, forming positions and others of the engagement portions 10*f* may be set appropriately.

On the other hand, fixation holes 10*h* are formed so that projecting portions 10*g* of the divided plates D1 are inserted and fixed in the fixation holes 10*h* at the positions of the tank plate 10*b* to fix the divided plates D1.

In addition, communicating holes 10*i*, 10*j* are formed to have a circular cross section at the positions of the tank plate 10*b* to fix connectors 5, 6.

As shown in FIG. 3, the tank 2 is constructed in such a way that it can be temporally assembled by caulking to fix the engagement portions 10*f* on the tank plate 10*b* after the both plates 10*a*, 10*b* are coupled with each other in a state where the divided plates D1 are disposed at predetermined positions.

In addition, the connectors 5, 6 are temporally assembled with the tank plates 10*b*, in a state where they are contacted with the tank plates 10*b*, by caulking annular projecting portions which are formed like an annular projection by the communicating holes 10*i*, 10*j* corresponding to the tank plate 10*b* to project outward by using a burring process before the both plates 10*a*, 10*b* are coupled with each other.

As shown in FIG. 4 and FIG. 5, the tank 3 is constructed in such away that it can be temporally assembled by caulking to fix the engagement portions 10*f* on the tank plate 10*b* after the both plates 10*a*, 10*b* are coupled with each other in a state where the divided plates D1 are disposed at predetermined positions, similarly to the tank 2.

In addition, communicating holes 10*k*, 10*m* are formed to have a circular cross section at the positions of the tank plate 10*b* corresponding to the intermediate plates 7, 8, respectively.

The core part 4 includes a plurality of flat tubes 4*a* and corrugated fins 4*b*, where both end portions of the flat tubes 4*a* are inserted to be fixed in corresponding tube holes 10*d* of the tube plates 10*a* of the tanks 2, 3, and corrugated top portions of the corrugated fins 4*b* are connected with the adjacent tubes 4*a*.

In addition, the both sides in a layer stack direction of the core part 4 are connected with and reinforced by a pair of reinforcement 11, 12, both end portions of which are inserted to be fixed in the corresponding reinforcement holes 10*c* of the tube plates 10*a* of the tanks 2, 3.

As shown in FIG. 6, the receiver tank 9 has a tank main body 13 shaped like a circular cylinder, an interior of which is closed by using a cap member 14*a* shaped like a disc to cover an upper portion of the tank main body 13 and a cover member 14*b* (shown in FIG. 8) to cover a lower portion thereof.

Incidentally, the tank main body 13 may be formed as a cylinder having a closed top portion so that the cap member 14*a* can be removed.

On an outer circumferential portion 9*a* of the receiver tank 9, a restricting portion 13*c* is formed to have a pair of side walls 13*a*, 13*a* facing to each other and a bottom portion 13*b* orthogonal to the side walls 13*a*, 13*a* in such a way that the restricting portion 13*c* has a cross section like a U-letter that opens toward the intermediate members 7, 8, extending over the entire length of the receiver tank 9.

In addition, circular communicating holes 13*d*, 13*e* are formed at positions of the bottom portion 13*b* of the restricting portion 13*c* to fix the intermediate members 7, 8.

The intermediate members 7, 8 are used for communicatably connecting the communicating holes 10*k*, 10*m* and the corresponding communicating holes 13*d*, 13*e* of the receiver tank 9 with each other, and also for fixing to support the receiver tank 9 on the tank 3.

The intermediate members 7, 8 are formed with penetrated communicating holes 7*a*, 8*a* with a circular opening cross section, tubular inserting portions 7*b*, 8*b* that project at the tank (3) side to extend the communicating holes 7*a*, 8*a*, and rectangular seat portions 7*c*, 8*c* provided at a receiver tank (9) side, respectively.

Further, between the inserting portions 7*b*, 8*b* and the seat portions 7*c*, 8*c* of the intermediate members 7, 8, intermediate portions 7*e*, 8*e* are formed to have contact surfaces 7*d*, 8*d* that are fittable to the outer circumferential portion of the tank plate 10*b* of the tank 3, respectively.

Incidentally, diameters of the openings of the communicating holes 13*d*, 13*e* formed in the restricting portion 13*c* are set to be somewhat larger than those of the communicating holes 7*a*, 8*a*.

As shown in FIG. 7 and FIG. 8, the intermediate members 7, 8 are fixed in a state where the inserting portions 7*b*, 8*b* are inserted into the communicating holes 10*k*, 10*m* of the tank plate 10*b* of the tank 3, the contact surfaces 7*d*, 8*d* being contacted with the outer circumferential portion of the tank plate 10, and the seat portions 7*b*, 8*b* being contacted with the inner side of the restricting portion 13*c*.

This fixation enables the communicating holes 10*k*, 10*m* of the tank 3 to be connected with the communicating holes 13*d*, 13*e* of the receiver tank 9 through the communicating holes 7*a*, 8*a* of the intermediate holes 7, 8, respectively.

Further, as shown in FIG. 9, the intermediate portions 7*e*, 8*e* and the seat portions 7*c*, 8*c* of the intermediate members 7, 8 are fixed by using the pairs of caulking portions 13*f*, 13*f*, the both side wall 13*a* of which are caulked toward the inner side.

Incidentally, the configurations, the number, the positions and others of the caulking portions 13*f* may be set appropriately, and a positioning construction different from caulking one may be employed.

As shown in FIG. 8, a metallic filter 15 is contained between the communicating hole 13*d* and the communicating hole 13*e* in the receiver tank 9.

Specifically, as shown in FIGS. 10-12, the metallic filter 15 includes a filter main body 16, a flange portion 17 and a metallic ring 18.

The filter main body 16 is formed like a circular cylinder with a closed bottom portion, having small holes like a net. The flange portion 17 is formed like a cylinder, and a top portion 17*a* thereof is fixed to an inner side of an opening end portion 16*a* of the filter main body 16 as shown in FIG. 13.

Further, a lower portion 17*a* of the flange portion 17 is formed to have an enlarged diameter portion 17*c* that slowly increases its diameter toward the bottom portion thereof.

Further, the metallic ring 18 is fixed on the outer side of the opening end portion 16*a* of the filter main body 16.

As shown in FIG. 8, a cylindrical bracket portion 19 is fixed on the inner side of the tank main body 13 of the receiver tank 9, and the flange portion 17 of the metallic filter 15 is fixed on the inner side of the cylindrical bracket portion 19.

This fixation forms an upper chamber P1, in the receiver tank 9, which is communicated with the fourth chamber R4 of the tank 3 through the communicating hole 7*a* of the intermediate member 7.

In addition, it forms a lower chamber P2 that is communicated with the upper chamber P1 through the filter main body 16 of the metallic filter 15 and that is also communicated with the fifth chamber R5 of the tank 3 through the communicating hole 8*a* of the intermediate member 8.

Each cap member 14*a*, 14*b* is formed like a disc, and an outer circumferential portion 14*c*, shaped like a ring is formed around its outer circumference to project along a longitudinal direction of the receiver tank 9.

Each cap member 14*a*, 14*b* is fixed to the tank main body 13 in a state where the end portion of the outer circumferential portion 14*c* thereof exists on the same surface of the end portion of the tank main body 13.

Further, all construction members of the condenser 1 of the first embodiment is made of aluminum or alloyed metal that mainly contains aluminum, stainless steel and others.

Next, the operation of the condenser 1 of the first embodiment will be described.

[On a Method for Manufacturing the Condenser]

In order to manufacture the condenser 1, all of the above-described construction members are temporally assembled, and then they are heated in a heating furnace to form them as one unit by brazing connecting portions of the construction members. Hereinafter, this manufacturing method will be specifically described.

[On Temporally Assembling the Receiver Tank]

When the receiver tank 9 is temporally assembled, the metallic filter 15 is temporally assembled in advance.

Specifically, the upper end portion 17*a* of the flange portion 17 is inserted into the inner side of the opening end portion 16*a* of the filter main body 16, and then the metallic ring 18 is inserted in the bottom portion side of the filter main body 16, and it is moved at the outer side position of the opening end portion 16*a*.

Thus, the filter main body 16 can be held in a state where the inner side of the metallic ring 18 and the upper end portion 17*a* of the flange portion 17 sandwich the opening end portion 16*a* of the filter main body 16. This improves a sealing performance therebetween, avoiding dropping of the filter main body 16.

Next, the bracket portion 19 is inserted from the lower end portion of the tank main body 13 in such a way that it is press-fitted therein at a predetermined position in a state where its diameter is slightly decreased.

Next, the metallic filter 15 is inserted from the lower end portion of the tank main body 13 so that the lower end portion 17*b* of the flange portion 17 is allocated in the bracket portion 19.

In this process, the lower end portion 17*b* and the enlarged diameter portion 17*c* of the flange portion 17 are press-fitted into the bracket portion 19 in a state where the diameters of the lower end portion 17*b* and the enlarged diameter portion 17*c* are slightly decreased. This improves a sealing performance therebetween, avoiding dropping of the metallic filter 15.

Next, the cap members 14*a*, 14*b* are press-fitted into the corresponding end portions of the tank main body 13, respectively.

<On Relatively Positioning the Intermediate Members and the Receiver Tank>

The intermediate members 7, 8 is temporally assembled in a state where the inserting portions 7*b*, 8*b* thereof are inserted into the communicating holes 10*k*, 10*m* formed in the tank plate 10*b* of the tank 3, respectively.

Next, the seat surfaces 7*c*, 8*c* of the intermediate members 7, 8 in a temporally assembled state are inserted in the restricting portion 13*c* to be allocated, and then the both side walls 13*a*, 13*a* are caulked in a thickness direction of the condenser 1, functioning as a heat exchanger, to form caulking portions 13*f*.

In this process, the side walls 13*a*, 13*a* contact with the side surfaces of the seat portions 7*c*, 8*c* of the intermediate members 7, 8 to guide these members 7, 8. This enables the intermediate members 7, 8 to be accurately positioned in a direction perpendicular to the longitudinal direction of the side walls 13*a* (a longitudinal direction of the core part 4 in a state where the receiver tank is attached to the core part 4).

In addition, the caulking portions 13*f* caulk the seat portions 7*c*, 8*c* and the intermediate portions 7*e*, 8*e* of the intermediate members 7, 8 with each other. This enables the seat portions 7*c*, 8*c* of the intermediate members 7, 8 to be held in a state where they closely contact with the both side walls 13*a*, 13*a* and the bottom portion 13*b* so that they cannot move relative to the restricting portion 13*c* in vertical and horizontal directions in FIG. 9.

Thus, relatively positioning the intermediate members 7, 8 and the restricting portion 13*c* enables the communicating holes 7*a*, 8*a* and the communicating holes 13*d*, 13*e* to be automatically positioned relative to each other. The intermediate members 7, 8 can be temporally assembled with the restricting portion 13*c* in a state where they are positioned.

Further, a certain relative displacement between the communicating holes 13*d*, 13*e* and the communicating holes 7*a*, 8*a* can be allowed in a up and down direction (a height direction) when the condenser 1 is attached on the vehicle, because the diameters of the openings of the communicating holes 13*d*, 13*e* are set slightly larger than the communicating holes 7*a*, 8*a*.

<On Design Freedom of the Interior of the Receiver Tank>

In the first embodiment, the restricting portion 13*c* is formed on the outer circumferential portion 9*a* of the receiver tank 9, and the seat portions 7*c*, 8*c* are fixed on the restricting portion 13*c* to communicatably connect therebetween, where the seat portions 7*c*, 8*c* function as connecting portions of the intermediate members 7, 8 which connects with the receiver tank 9.

This can increase the design freedom of the interior of the receiver tank 9, because the seat portions 7*c*, 8*c*, which function as the connecting portions of the intermediate members 7, 8 to connect with the receiver tank 9, do not closely approach or contact with a construction portions/parts in the receiver tank 9.

In the first embodiment, the design freedom can be increased in a size, an arrangement and others of the metallic filter 15.

Incidentally, the construction part in the receiver tank 9 is not limited to the metallic filter 15, and it may be various pipes, a drying agent and others.

Finally, the receiver tank 9 and the condenser 1 are brazed, being maintained a state where they are temporally assembled.

[On a Brazing Process]

<On Brazing Filler Material on the Vicinities of the Receiver Tank and the Intermediate Members>

On at least one of the connecting portions of the construction members described above, brazing filler material is provided, where the brazing filler material in made of a brazing sheet or it is made of a coated or stuck flux.

As shown in FIG. 13, brazing filler material 20*a* is provided on an outer surface of the flange portion 17 in the vicinity of the metallic filter 15 of the first embodiment.

In addition, the brazing filler material is provided on an inner surface of the cap members 14*a*, 14*b*.

Further, the intermediate members 7, 8 and the tank main body 13 are connected with each other by using a member with holes being connected on the surfaces of the connecting portions that connects the intermediate members 7, 8 and the tank main body 13, where the member is formed of a brazing sheet whose not-shown both surfaces are clad, being formed to have rectangular surfaces similar to those of the tank main body (13) side of the intermediate member 7, 8. Alternatively, they are connected by using not-shown depressed portions being formed on the tank main body (9) side surfaces of the connecting portions of the intermediate members 7, 8 and ring brazing filler material containing flux (flux cored wire) being provided in the depressed portions.

Incidentally, the thickness of the brazing filler material may be appropriately set. In general, it is set to be more than 10% of the thickness of base material.

<On Fixation by Brazing of the Metallic Filter>

In the brazing process, the brazing filler material 20*a* melts to fix the flange portion 17 and the bracket portion 18 with each other, also fixing the metallic ring 18, the opening end portion 16*a* of the filter main body 16 and the upper end portion 17*a* of the flange portion 17 by brazing.

In this process, the metallic ring 18 can prevent a portion of the brazing filler material 20*a* from flowing toward the metallic filter 15.

This enables the metallic filter 15 to avoid from clogging thereof due to capillary phenomenon of the melted brazing filler material 20*a*.

In addition, a portion of the brazing filler material 20*a* melts to fix the metallic ring 18 through the metallic filter 15 by brazing, thus firmly fixing them.

Further, no brazing filler material is provided on the inner surface of the tank main body 13 in the first embodiment. Accordingly, there is no possibility that the metallic filler 15 is clogged due to the melted brazing filler material that is introduced along the inner surface of the flange portion 17 to flow therein through the inner side of the metallic filter 15.

<On Fixation of the Cap Members by Brazing>

Further, the melted brazing filler material, which is provided on the inner surfaces of the cap members 14*a*, 14*b*, can fix the outer circumferential portion 14*c* of the cap members 14*a*, 14*b* on the tank main body 13. Accordingly, the interior of the receiver tank 9 can be easily and surely sealed.

Incidentally, the brazing filler material may be provided on the inner surface of the tank main body 13, and the cap members 14*a*, 14*b* can be fixed by using the melted brazing filler material.

<On Fixation of the Condenser and the Receiver Tank by Brazing>

In addition, the connecting portions between the intermediate members 7, 8 and the tank plate 10*b*, the receiver tank 9 can be fixed with each other by brazing, so that the receiver tank 9 can be fixed and supported to the tank plate 10*b* through the intermediate members 7, 8 due to the melted brazing filler material provided on the outer surface of the tank main body 13 of the tank plate 10*b* of the tank 3 and the outer surface of the tank main body 13, or on the outer surfaces of the intermediate members 7, 8.

Herein, a brazing process of the condenser 1 is normally executed in a state where the core part 4 is horizontally placed. In this process, there is a high possibility of occurrence of a relative displacement between the receiver tank 9 and the intermediate members 7, 8 especially in a direction vertical to a longitudinal direction of the side wall 13*a* (in a lateral direction of the core part 4 in a state where the receiver tank is attached to the core part 4) because a weight of the receiver tank 9 acts on the intermediate members 7, 8 in the vertical direction.

Incidentally, when there is a relative displacement between the intermediate members 7, 8 and the receiver tank 9, a displacement occurs between the communicating holes 13*d*, 13*e* and the communicating holes 7*a*, 8*a*, consequently increasing a pressure loss of the flowing medium.

In order to avoid the above-described problem, the diameters of the openings of the communicating holes 13*d*, 13*e* are set to be somewhat larger than those of the communicating holes 7*a*, 8*a* so as to allow the displacement therebetween. However, setting the diameters of the openings of the communicating holes 13*d*, 13*e* to be larger too much cannot ensure connecting areas of the intermediate members 7, 8 and the receiver tank 9. This causes enlargement in sizes of the intermediate members 7, 8 and poor brazing thereof.

On the contrary, as described above, in the condenser 1 of the first embodiment, the both side walls 13*a*, 13*a* of the restricting portion 13*c* contact with the side surfaces of the seat portions 7*c*, 8*c* of the intermediate members 7, 8, and the seat portions 7*c*, 8*c* are fixed by using the caulking portions 13*f*. Accordingly, the possibility of the displacement of the intermediate members 7, 8 in the brazing process can be removed, so that they are joined by brazing in a state where they are properly positioned.

In addition, the positioned state is maintained after the brazing process, which can improve endurance in fixation, thereby improving durability of the condenser 1.

[On the Operation of the Condenser]

In the thus-constructed condenser 1, while the flowing medium at a high temperature about 60° C., which flows in the first chamber R1 of the tank 2 from the engine side through the input port 5*a* of the input connector 5, flows in the second chamber R2 at first, then the third chamber R3, and then the fourth chamber R4 through the corresponding tubes 4*a* of the core part 4, turning in order of the above chambers, the flowing medium is cooled down due to heat exchange with air flow passing through the core art 4 or forced air flow generated by a not-shown fan.

Next, as shown in FIG. 8, the flowing medium (shown by a dashed lined arrow), which flows in the fourth chamber R4 of the tank 3 through the communicating hole 7*a* of the intermediate member 7, flows in the upper side chamber P1 of the receiver tank 9 through the communicating hole 7*a* of the intermediate member 7 to be vapor-liquid separated, and then the medium flows in the lower chamber P2 through the metallic filter 15.

In this operation, contaminations included the flowing medium is removed by the filter main body 16 of the metallic filter 15.

Next, the flowing medium in the lower chamber P2 flows in the fifth chamber R5 of the tank 3 through the communicating hole 8*a* of the intermediate member 8.

Finally, while the flowing medium, which flows in the fifth chamber R5 of the tank 3, flows in the sixth chamber R6 of the tank 2 through the corresponding tubes 4*a* of the core part 4 is over-cooled to about 45° C. due to the heat exchange with the air flow passing through the core part 4 or the forced air flow generated by the fan, the medium flows out toward an evaporator side through the output port 6*a* of the output connector 6. Therefore, they function as a heat exchanger.

[On of an Air Guide Operation of the Fixing Portions]

In the first embodiment, the both side walls 13*a*, 13*a* of the restricting portion 13*c* is provided along the receiver tank 9 over the entire length thereof.

This can decrease a clearance between the tank 3 and the receiver tank 9 of the condenser 1.

Accordingly, deterioration in heat radiation performance can be avoided, because a large amount of wind flows from a front side through the clearance between the tank 3 and the receiver tank 9 of the condenser 1, in which flow resistance becomes lower, so as to properly pass through the core part 9.

In addition, it can avoid the deterioration in heat radiation performance due to hot air blowing back from the engine side, where a not-shown engine is arranged at a rear side of the condenser 1, toward the front side through the clearance between the tank 3 and the receiver tank 9 of the condenser 1.

Figure 14:
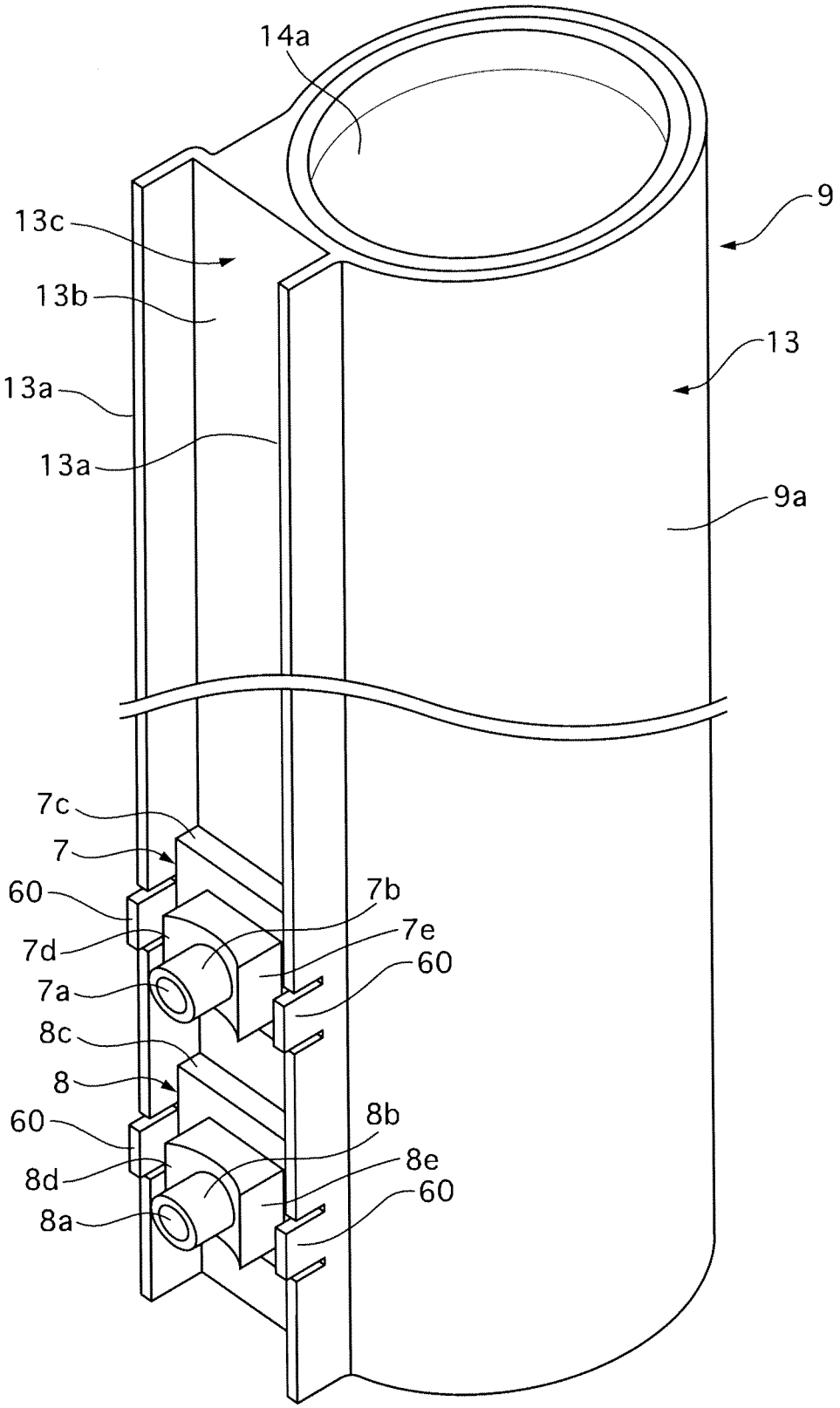
FIG. 14 is a view showing a modified example of the first example, namely a fixing construction of the intermediate members and the receiver tank before they are caulked with each other.

Incidentally, the caulking portions 13*f* are formed to be continued with the both side walls 13*a*, 13*a* of the fixing portion 31*c* in the first embodiment, which is not limited. For example, as shown in FIG. 14, the both side walls 13*a*, 13*a* may be partially cut off at positions corresponding to the intermediate members 7, 8 to form claw portions 60*f* shaped like a claw as shown in FIG. 14 and then the claw portions 60 may be bent to be fixed on the intermediate members 7, 8 by caulking. In this case, the configurations, the formation positions, the formation number and others of the claw portions 60 may be appropriately set. In addition, the restricting portion 13*c* (the both side walls 13*a*, 13*a* and the caulking portions 130, which restricts the relative displacement between the receiver tank 9 and the intermediate members 7, 8, restricts the intermediate members 7, 8 so as not to be relatively moved in every direction, while, in some cases, it may be constructed to allow a movement in a direction vertical to the attachment surface (the bottom portion 13*b*), restricting a movement in an up-and-down and right- and left direction in FIG. 9 relative to the attachment surface (the bottom portion 13*b*).

Next, the advantages of the condenser 1 with the receiver tank 9 of the first embodiment will be listed.

(1) In the receiver tank 9 in which the tank 3 and the receiver tank 9 of the heat exchanger (condenser 1) are connected to be communicated with each other through the intermediate members, the restricting portion 13*c* (the both side walls 13*a*, 13*a* and the caulking portions 130, which restricts the relative displacement between the receiver tank 9 and the intermediate members 7, 8, is provided on the outer circumferential portion of the receiver tank 9.

This avoids projection of the intermediate members 7, 8 into the receiver tank 9, thereby removing the possibility of close approximation or contact of the members 7, 8 and a construction member, such as the metallic filter 15, provided in the receiver tank 9. Accordingly, the design freedom of the interior of the receiver tank 9 can be increased.

In addition, the fixation performance in the brazing process can be improved, thereby reliability of a product being improved.

(2) The both side walls 13*a*, 13*a* of the restricting portion 13*c* are constructed to restrict the relative displacement of the heat exchanger (condenser 1) between the intermediate members 7, and the receiver tank 9 in the lateral direction.

This avoids the relative displacement between the intermediate members 7, 8 and the receiver tank 9 in the brazing process, which is desirable.

(3) In the receiver tank 9 in which the tank 3 and the receiver tank 9 of the heat exchanger (condenser 1) are connected to be communicated with each other through the intermediate members 7, 8, the restricting portion 13*c*, which extends in the longitudinal direction of the receiver tank 9 and has the cross section shaped like the U-letter, is provided on the outer circumferential portion 9*a* of the receiver tank 9. The restricting portion 13*c* guides the connecting portions (the seat portions 7*e*, 8*e*) of the intermediate members 7, 8, and they are fixed by brazing in the state they are positioned. This enables the heat exchanger to be constructed as a simple construction at a low cost in order to provide the advantages similar to (1) and (2)

(4) The facing both side walls 13*a*, 3*a* of the restricting portion 13*c*, which is shaped like the U-letter, is fixed to the intermediate members 7, 8 by caulking.

This enables the intermediate portions 7, 8 to be easily and temporally assembled with the restricting portion 13*c*, improving the endurance in their fixation.

(5) The restricting portion 13*c* is provided over the entire length of the receiver tank 9.

This enables the both side walls 13*a*, 13*a* of the restricting portion 13*c* to also function as the air guide.

The Second Embodiment

Hereinafter, the second embodiment will be described.

In the second embodiment, construction members similar to those of the first embodiment are indicated by the same reference numbers, their explanations being omitted, and only different members will be described in detail.

Figure 15:
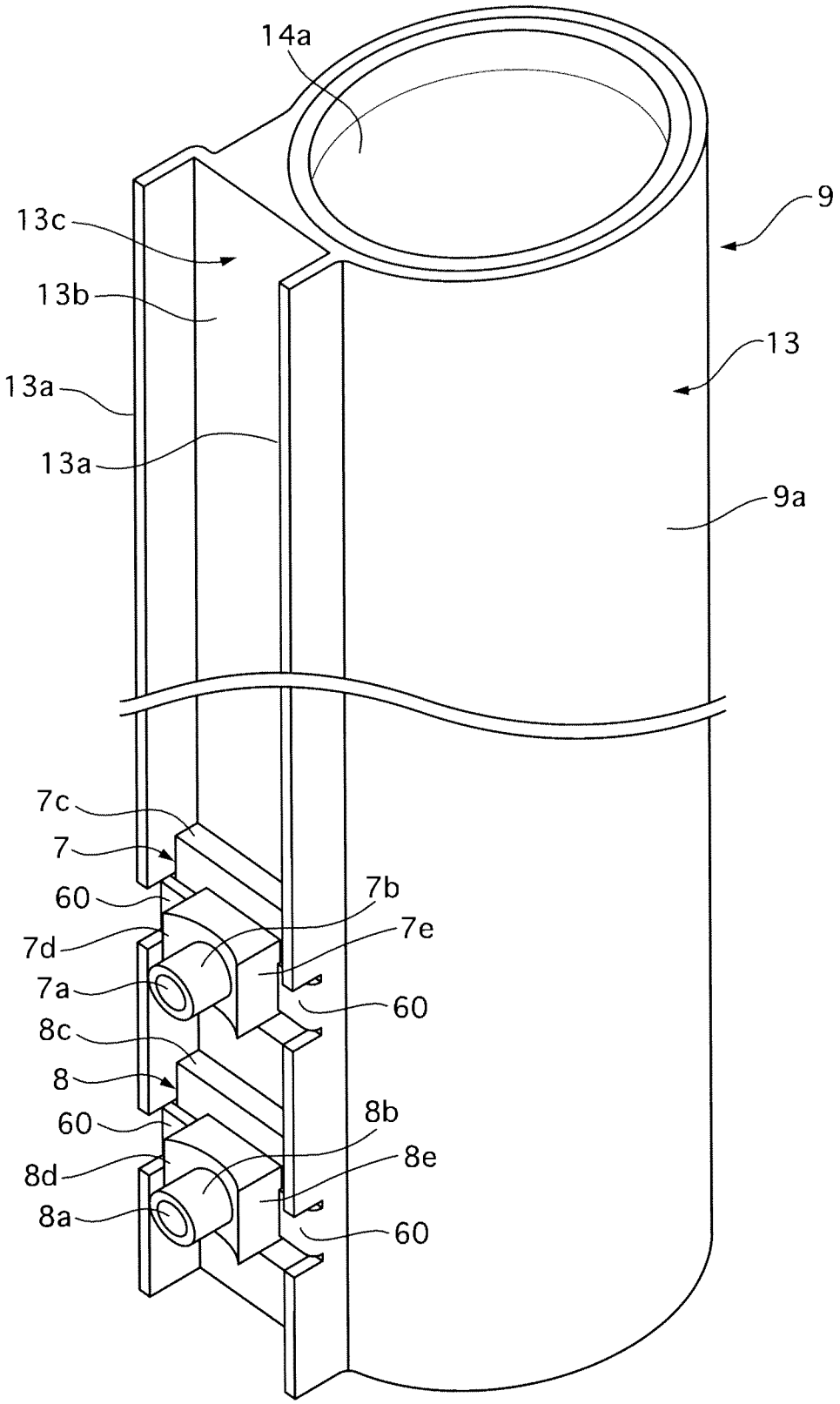
FIG. 15 is a view explaining the fixing construction of the intermediate members and the receiver tank shown in FIG. 14 after they are caulked with each other.
Figure 16:
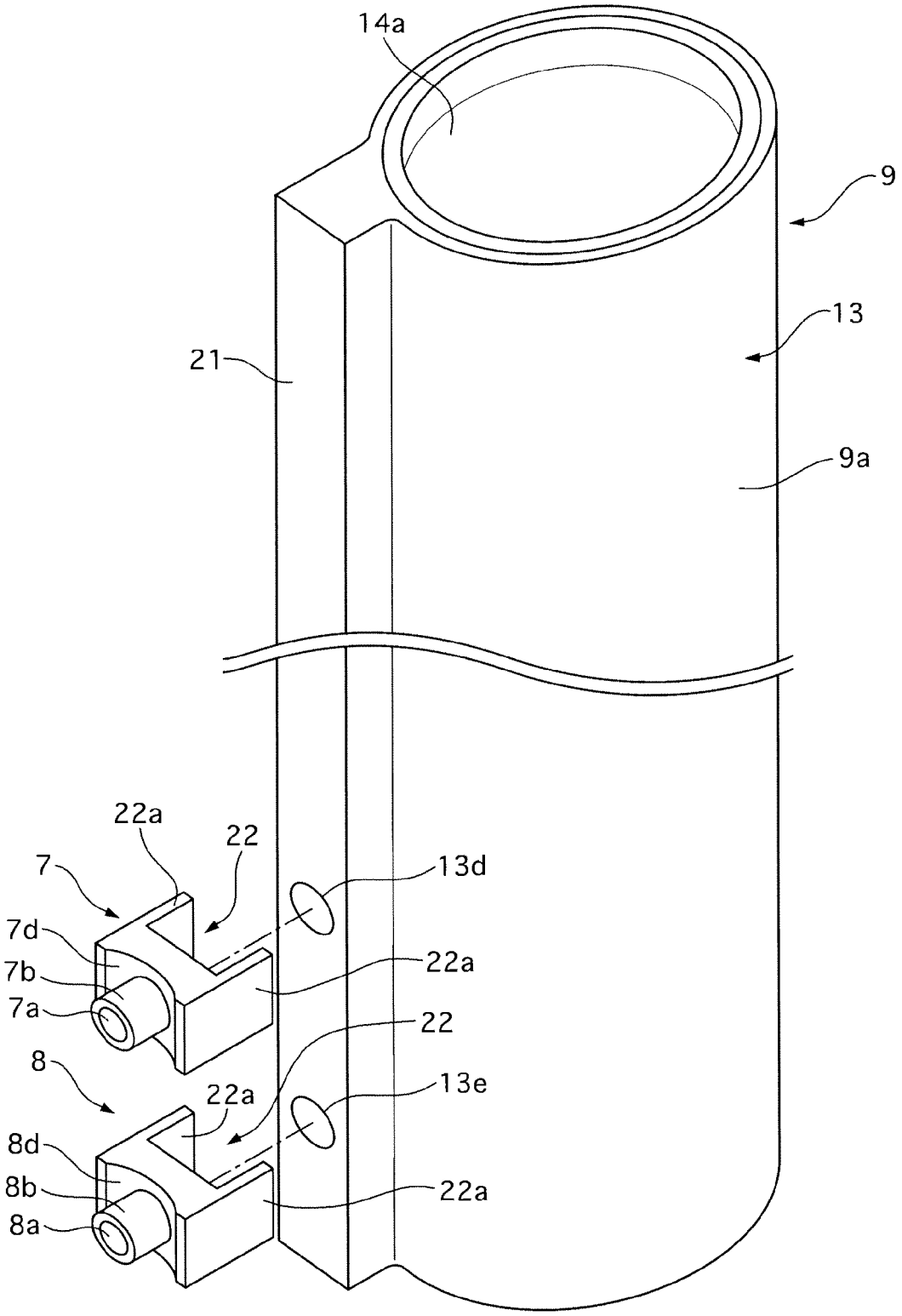
FIG. 16 is an exploded perspective view of intermediate members and a receiver tank that are used in a second embodiment.
Figure 17:
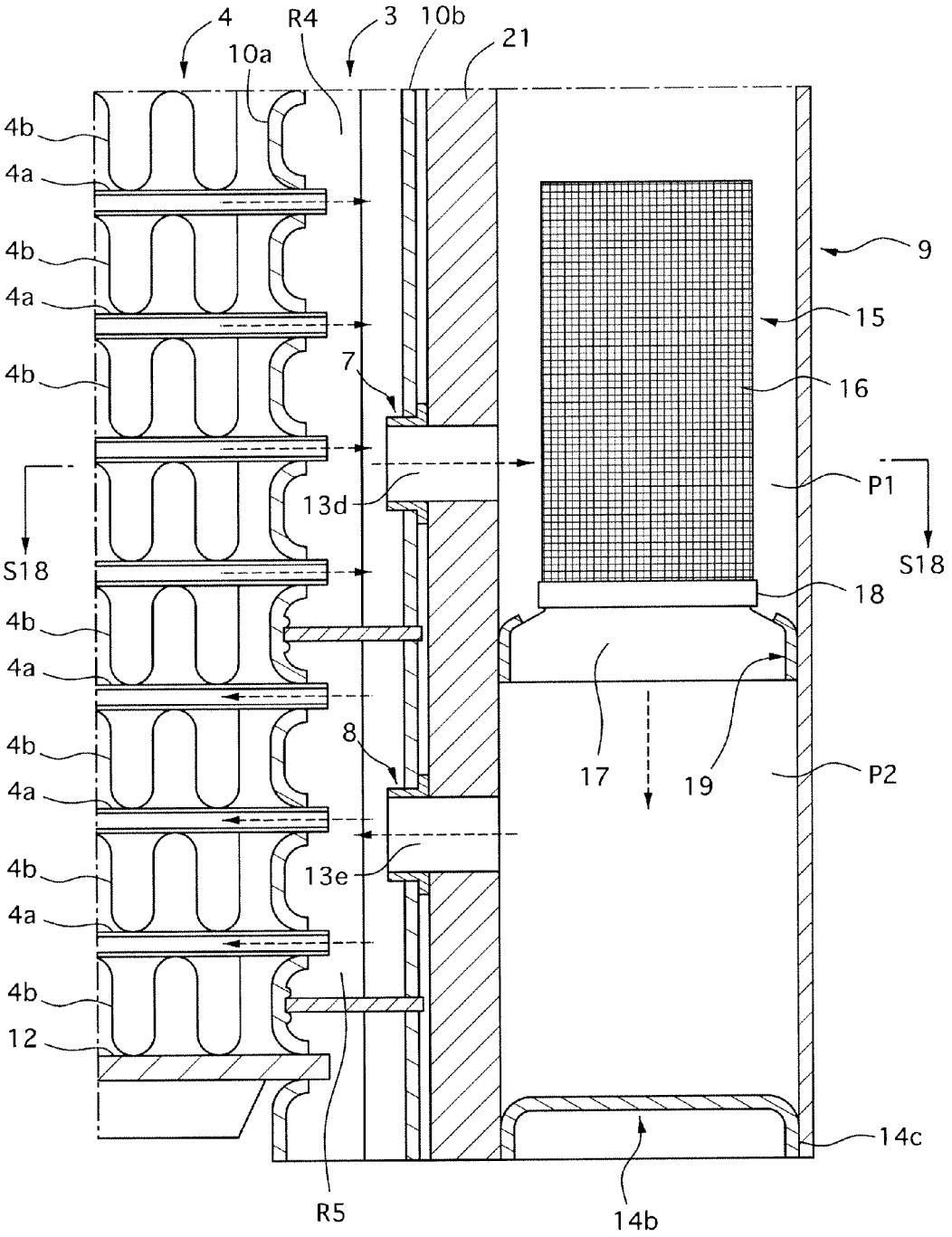
FIG. 17 is a cross sectional view showing a fixing construction of the intermediate members and the receiver tank shown in FIG. 16.
Figure 18:
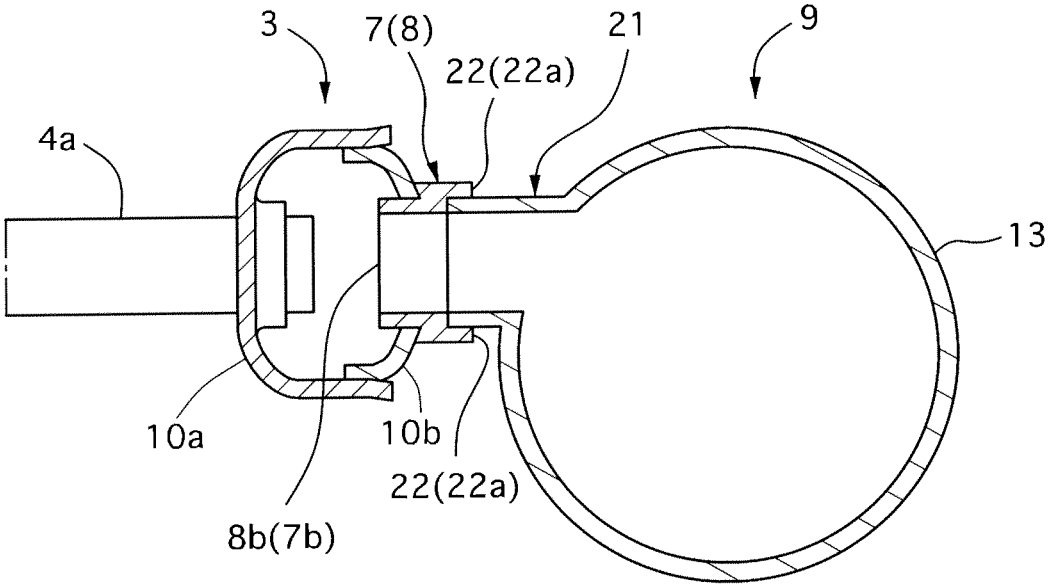
FIG. 18 is a cross sectional view taken along the line S18-S18 in FIG. 17.

FIG. 16 is an exploded perspective view of a receiver tank and intermediate members that are used for the second embodiment, FIG. 17 is a view explaining a fixation construction of the receiver tank and the intermediate members, and FIG. 18 is a cross sectional view taken along the line S18-S18 in FIG. 15.

The restricting portion 13*c* (the both side walls 13*a*, 13*a* and the caulking portion 130, which positions the intermediate members 7, 8 and the receiver tank 9, is provided at the receiver tank (9) side in the above described first embodiment, while it is provided at the intermediate member (7, 8) side in the second embodiment.

Specifically, as shown in FIG. 16, a connecting portion 21 is formed over the entire length of a receiver tank 9, projecting toward a tank 3 of a condenser 1 in a rectangular shape on an outer circumferential portion 9*a* of the receiver tank 9. The connecting portion 21 has an attachment surface of the intermediate members 7, 9.

On the other hand, fixing portions 22 are formed on the connecting portion sides of the intermediate members 7, 8, having a cross section shaped like a U-letter and opening toward the receiver tank 9, respectively.

Further, as shown in FIG. 16 and FIG. 18, the both side walls 22*a*, 22*a*, which face to each other, of the cross section shaped like the U-letter of each fixing portion 22 of the intermediate members 7, 8 are fixed by caulking on the side surfaces of the connecting portion 21 of the receiver tank 9 so that these both ones can be connected by brazing in a state where they are temporally assembled. The both side walls 22*a*, 22*a* constitute a restricting portion.

Figure 19:
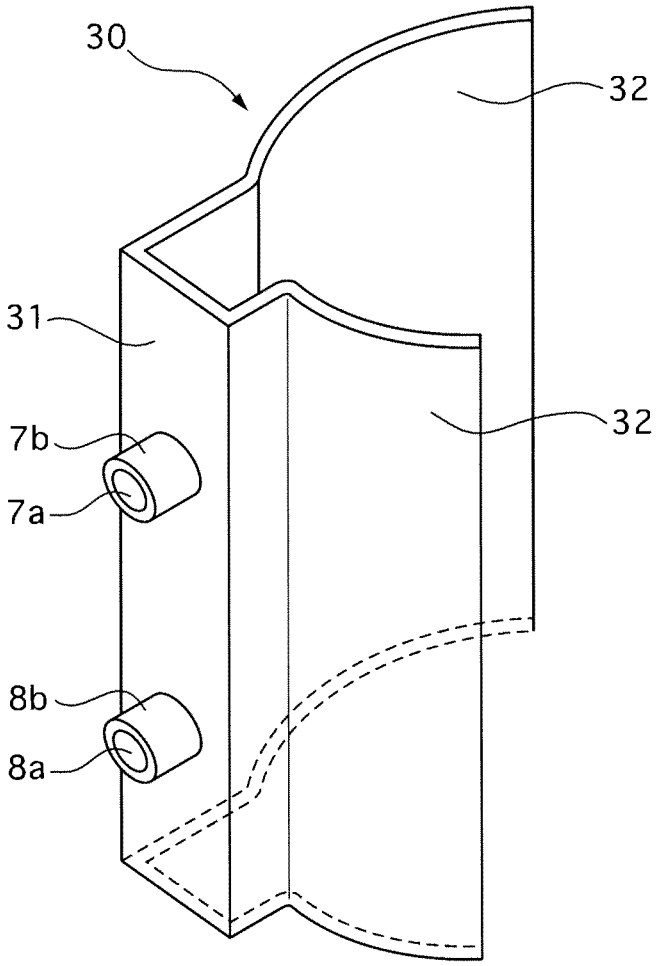
FIG. 19 is a perspective view of an intermediate member that is used for a modified example of the second embodiment.
Figure 20:
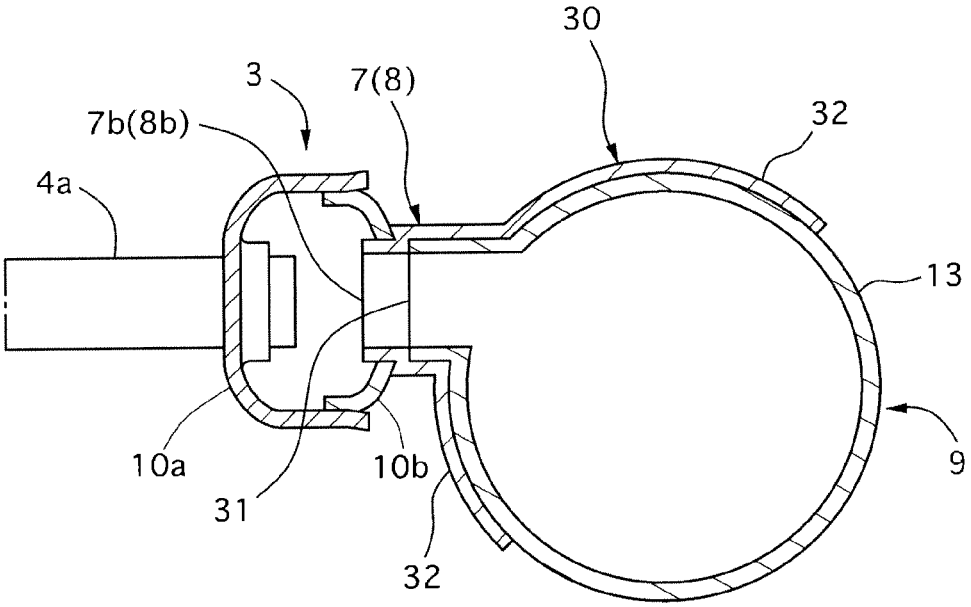
FIG. 20 is a cross sectional view, taken along the line S20-S20 in FIG. 24, of the fixing construction of the receiver tank and the intermediate member that are used for the modified example of the second embodiment.

Incidentally, the connecting portions of inserting portions 7*b*, 8*b* of the intermediate members 7, 8 are not limited to the both side walls 22*a*, 22*a* shaped like a flat configuration of the connecting portions 22 of the intermediate members 7, 8 shown in FIG. 16 and FIG. 18. As shown in FIG. 19, they may be a fitting portion 30 shaped like a half circular cylinder and including a restricting portion 31 and a fixing portion 32. The restricting portion 31 has a cross section shaped like a U-letter opening to be fittable to the connecting portion 21 of the receiver tank 9. The fixing portion 32 has a curved surface that extends from the facing both side walls of the cross section shaped like the U-letter so as to be fittable to a portion of an outer circumferential portion 9*a*. In this case, as shown in FIG. 20, the restricting portion 31 provided with the intermediate members 7, 8 is fitted to the connecting portion 21 of the receiver tank 9, and further the fixing portion 32 provided with the intermediate members 7, 8 is fitted to a portion of the outer circumferential portion 9*a* of the receiver tank 9, so that they can be fixed in the state where they are positioned. Incidentally, the fitting portion 30 may be two parts by being divided between the intermediate members 7, 8. In addition, the order of fixing the intermediate members 7, 8, the tank 3 and the receiver tank 9 may be appropriately set.

Accordingly, the second embodiment can have the operation and the advantages similar to those of the first embodiment.

In addition, using the fitting portion 30 shaped like the half circular cylinder as shown in FIG. 19 and FIG. 20 can decrease the number of parts of the intermediate members 7, 8, providing more stable fixation of the receiver tank 9.

The Third Embodiment

Hereinafter, a third embodiment will be described.

In the third embodiment, construction members similar to those of the first embodiment are indicated by the same reference numbers, their explanations being omitted, and only different members will be described in detail.

Figure 21:
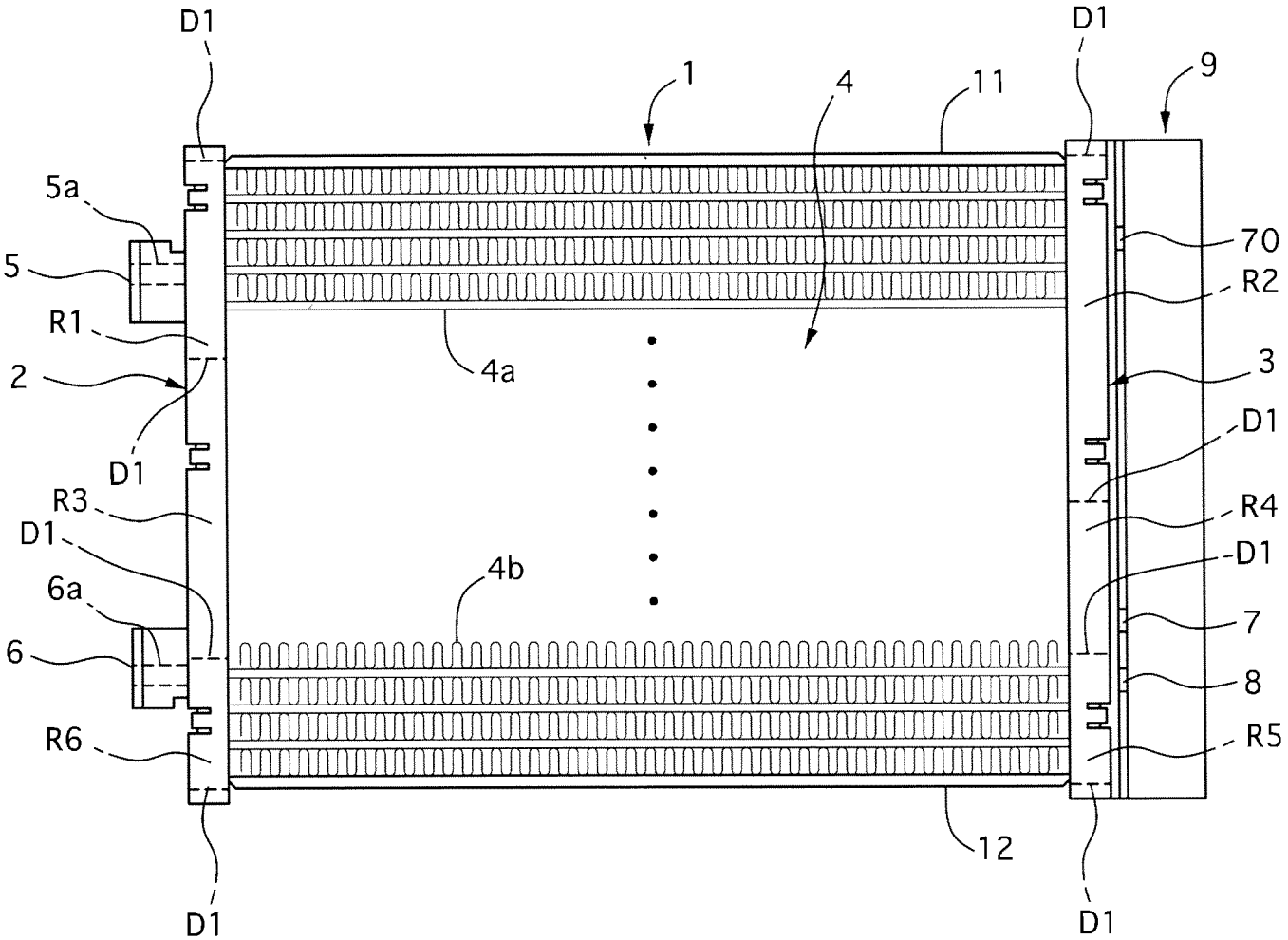
FIG. 21 is a front view of a condenser with a receiver tank of a third embodiment.
Figure 22:
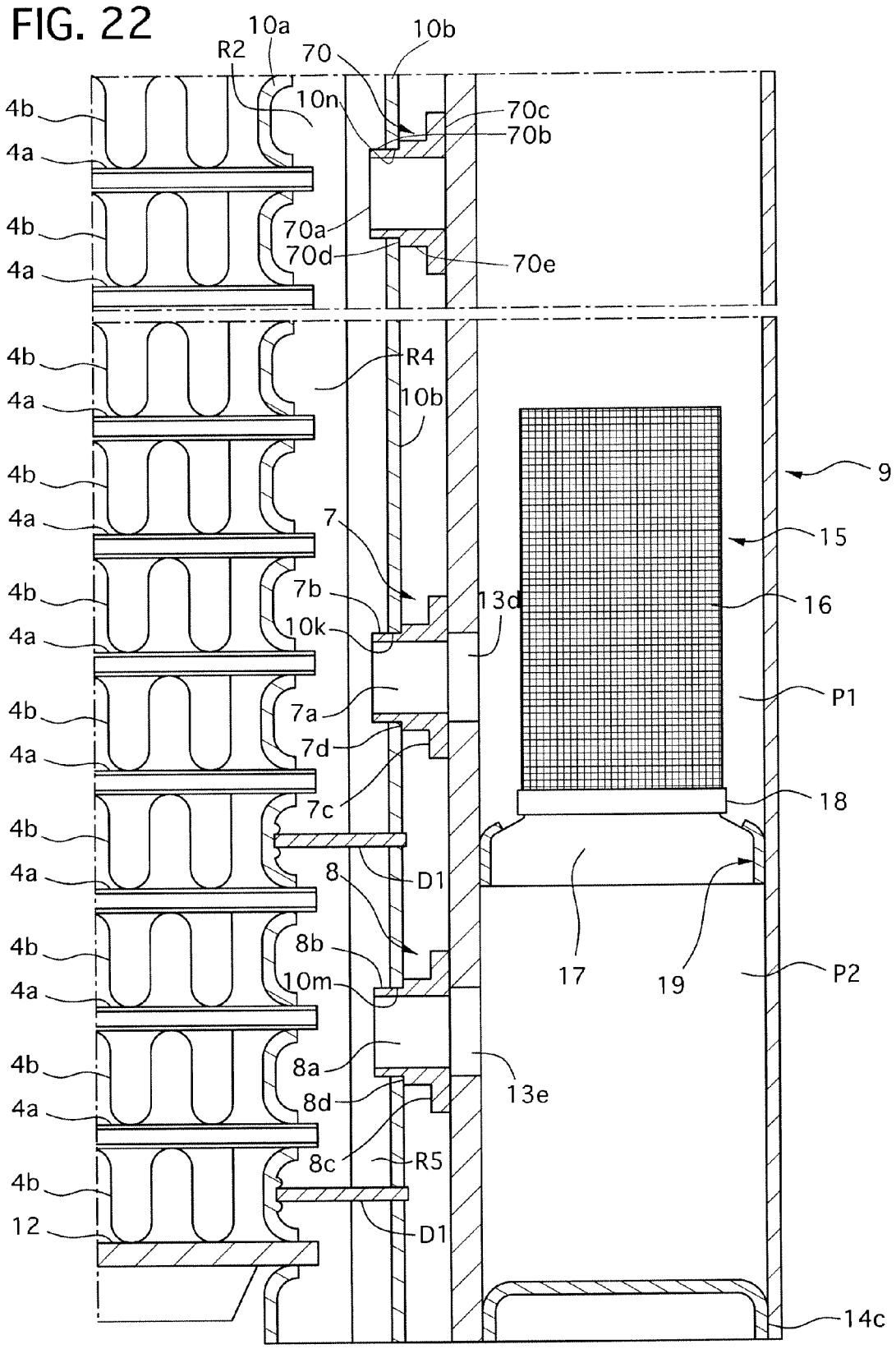
FIG. 22 is a cross sectional view of a fixing construction of a receiver tank, intermediate members, and a holding member shown in FIG. 21.
Figure 23:
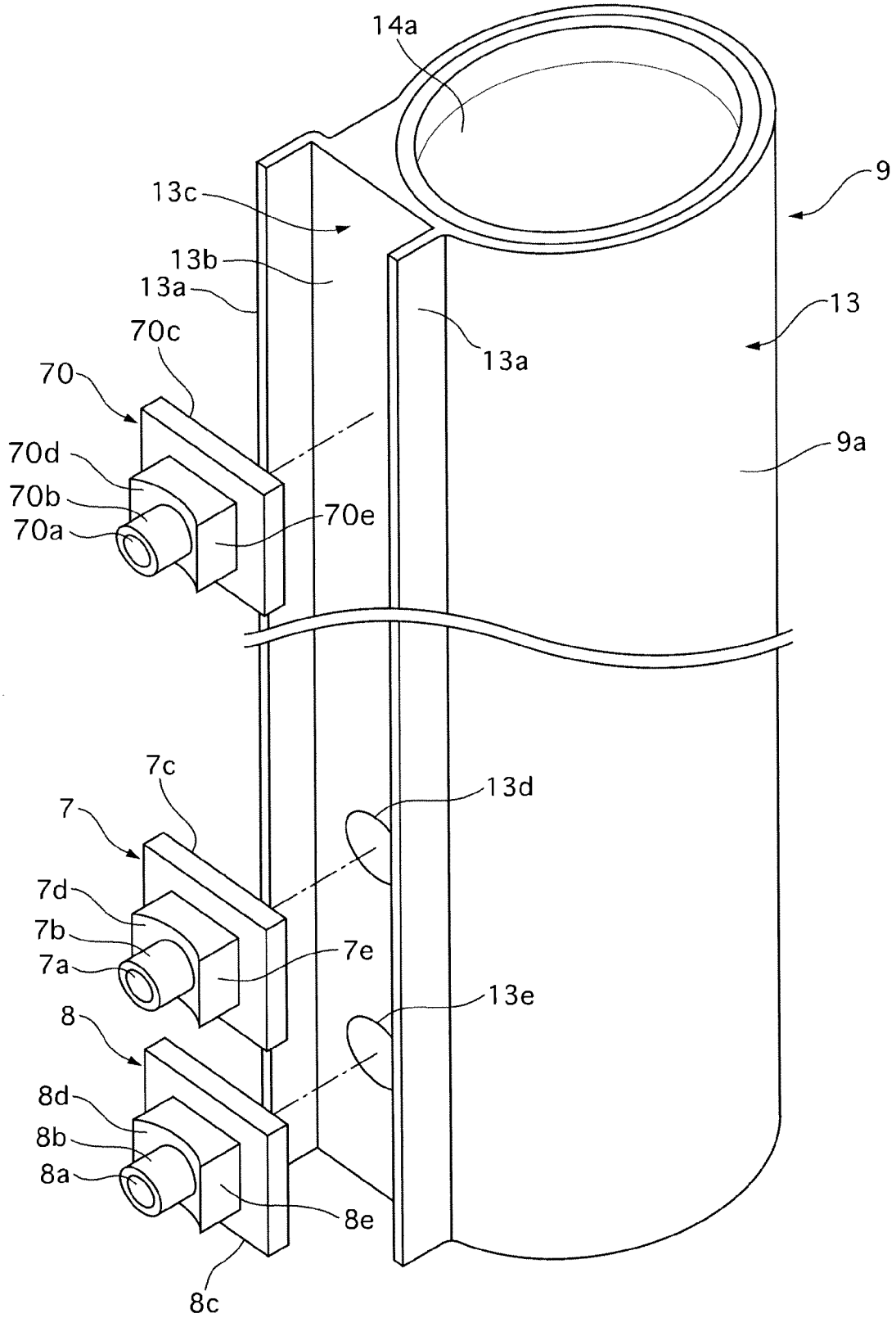
FIG. 23 is an exploded perspective view of the intermediate members and the receiver tank of the third embodiment.
Figure 24:
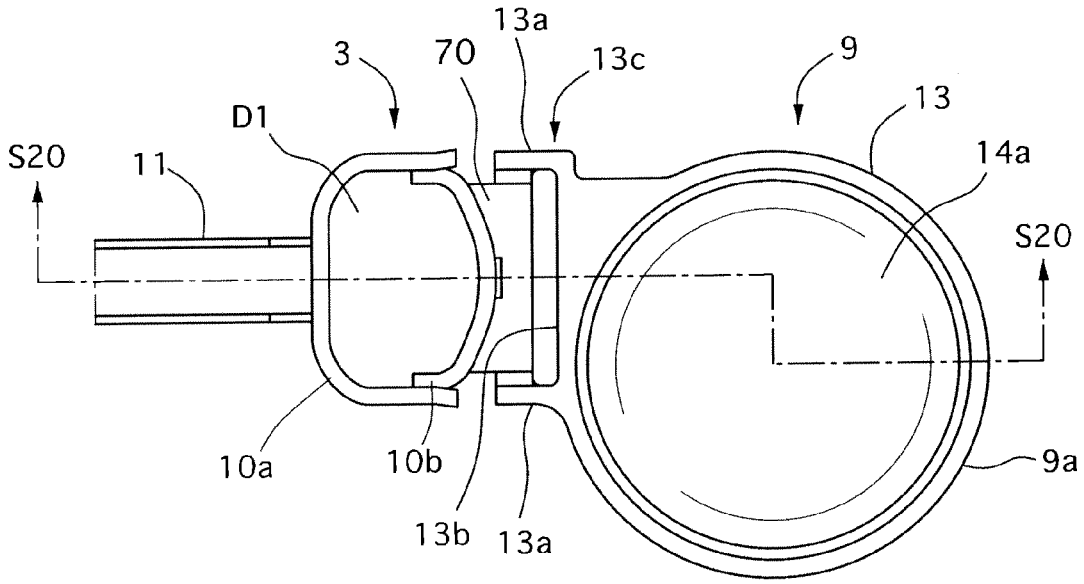
FIG. 24 is a top view showing a fixing construction of the receiver tank and the holding member of the third embodiment.
Figure 25:
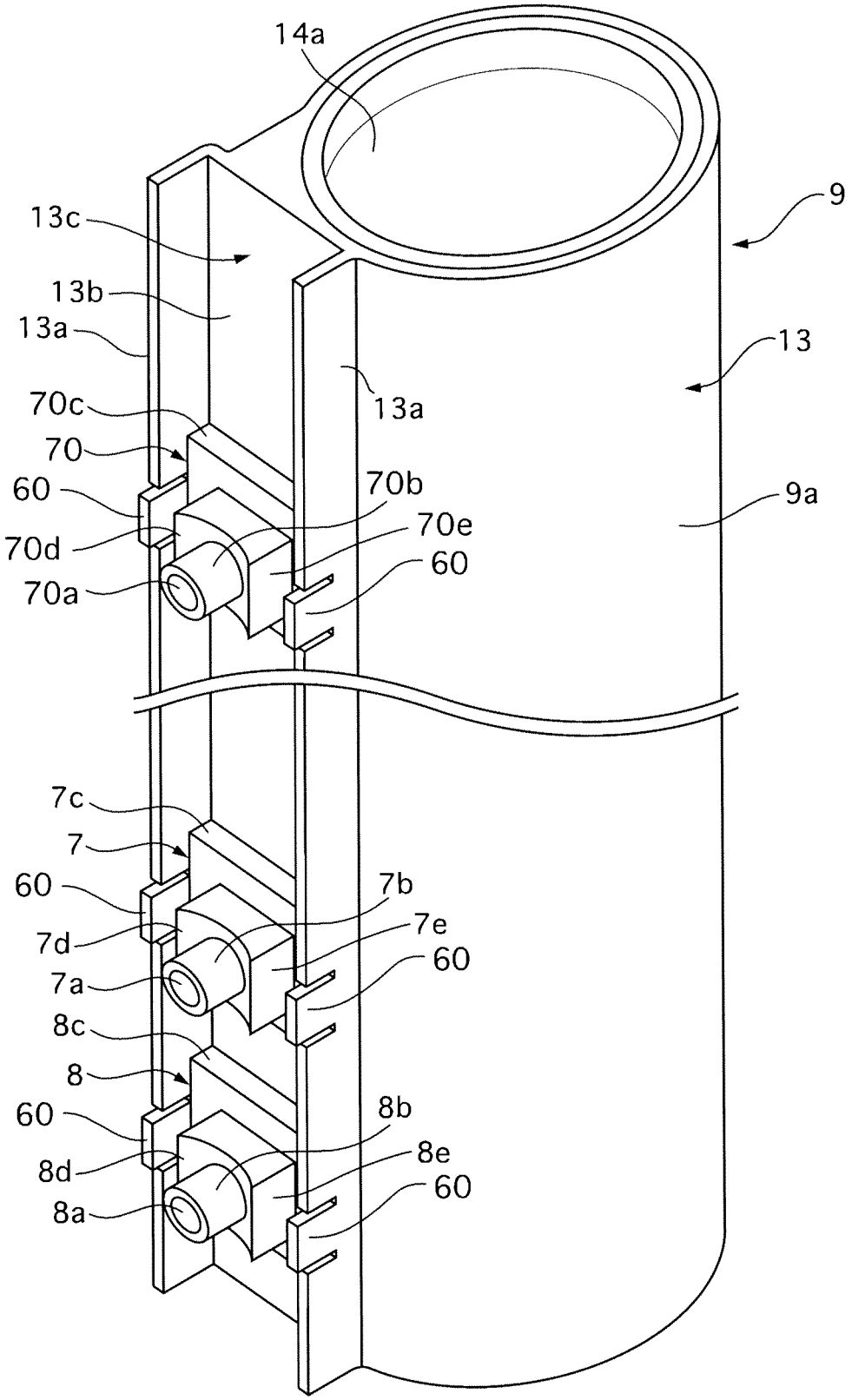
FIG. 25 is a perspective view showing the fixing construction of intermediate members and a receiver tank of a modified example of the third embodiment before they are caulked with each other.

FIG. 21 is a front view of a condenser with a receiver tank of the third embodiment, FIG. 22 is a cross sectional view of an example in which the receiver tank used in the third embodiment is fixed on a tank of the condenser by using intermediate members and holding member, FIG. 23 is an exploded perspective view of the intermediate members, the holding member and the receiver tank, and FIG. 24 is a top view of the vicinity of the receiver tank.

As shown FIGS. 21-24, in the third embodiment, a lower portion of a tank 3 of a condenser 1 and a lower portion of a receiver tank are fixed to each other by using the intermediate members 7, 8 of the first embodiment, and further an upper portion of the tank 3 and a lower portion of the receiver tank 9 are fixed and supported by using a holding member 70.

The holding member 70 is used for fixing and supporting an upper end portion of the receiver tank 9 to the tank 3. In this embodiment, it employs a member having the same configuration as the intermediate members 7, 8 in order to decrease its manufacturing costs, and it is formed to have a communicating hole 70*a*, an inserting portion 70*b*, a seat portion 70*c*, a contact surface 70*d* and an intermediate portion 70*e* similarly to the intermediate members 7, 8.

Further, as shown in FIG. 22, the holding member 70 is fixed similarly to the intermediate members 7, 8 in a state where the inserting portion 70*a* is inserted into a communicating hole 10*n* of a tank plate 10*b* of the tank 3 so that the contact surface 70*d* contacts with the outer circumferential portion of the tank plate 10 and in a state where the seat portion 70*c* contacts with both side walls 13*a*, 13*a* and a bottom portion 13*b* of a restricting portion 13*c*.

Further, the intermediate portion 70*e* of the holding member 70 is fixed by caulking similarly to the intermediate members 7, 8 by using a pair of caulking portions formed by the both side walls 13*a*, 13*a* of the restricting portion 13 being caulked inside. Incidentally, a temporally assembled construction and a fixation construction of the tank 3 and the receiver tank 9 which are fixed through the holding member 70 are similar to those of the intermediate members 7, 8, and accordingly their explanations are omitted. Thus, the intermediate members 7, 8 and the holding member 70 are arranged on a line along the fixing portion 13 in an up and down direction on the outer circumferential portion of the receiver tank 9.

As a result, this construction can remove a work of fastening the upper portion of the tank of the condenser and the upper portion of the receiver tank by using a fastening member (C-type cramp or others) in a post-process after a heating process.

In addition, the holding member 70 is formed to have the same configuration as those of the intermediate members 7, 8, and accordingly the number of kinds of parts can be decreased.

Further, it can improve vibration tolerance relative to those of C-type cramps, thereby improving its product reliability.

Figure 26:
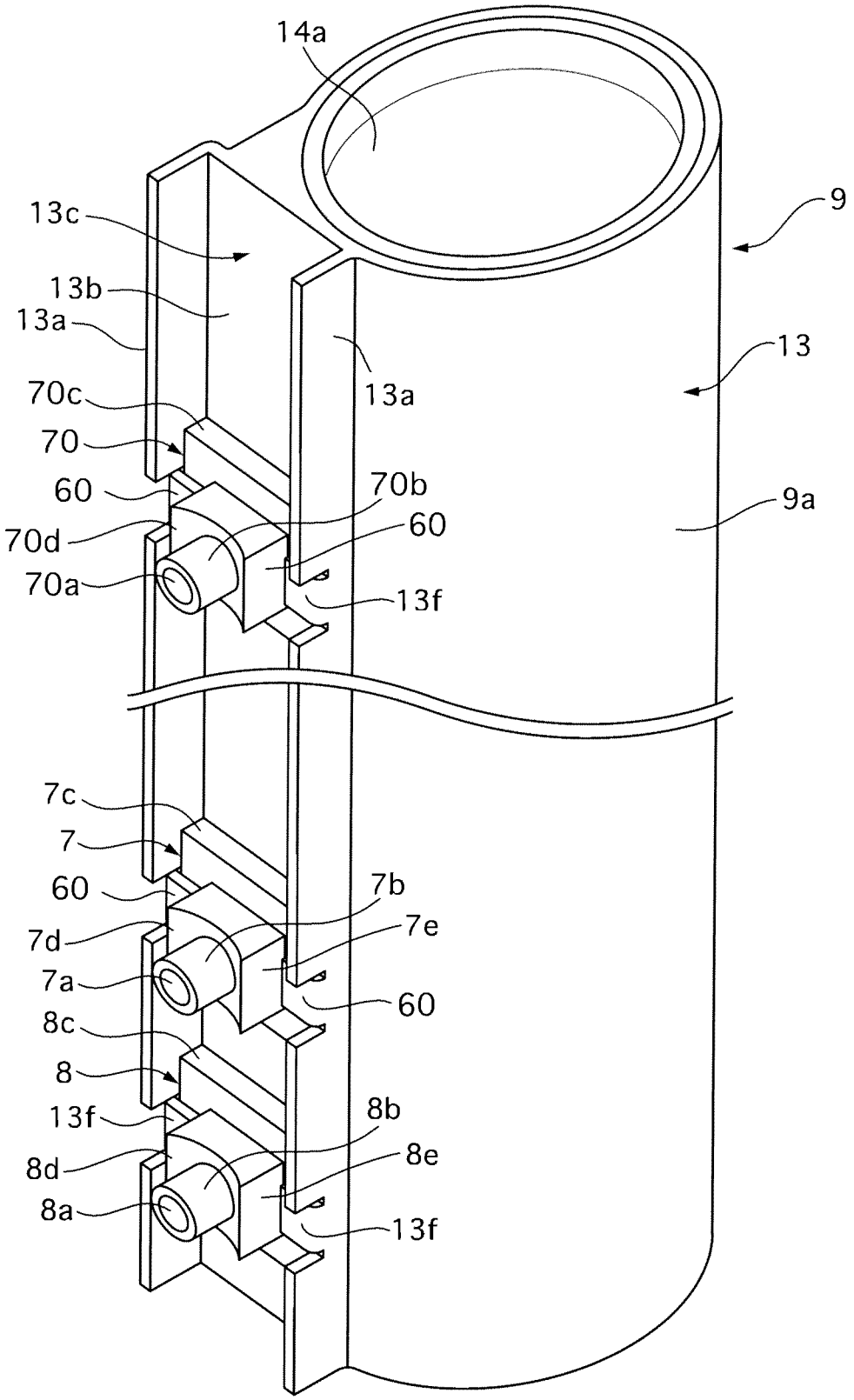
FIG. 26 is a perspective view showing the fixing construction of the intermediate members and the receiver tank of the modified example of the third embodiment after they are caulked with each other.

Incidentally, in the third embodiment, instead of the continuous both side walls 13*a*, 13*a*, the restricting portion 13*c* may be constructed in such a way that portions of both side walls 13*a*, 13*a* may be partially cut off to form claw portions 60 shaped like a claw at positions corresponding to attachment positions of the intermediate members 7, 8 and the holding member 70, and then the claw portions 60 are bent to fix the intermediate members 7, 8 and the holding member 70 by caulking as shown in FIG. 26, respectively. In this case, the configurations, the formation positions and the formation number of the claw portions 60 may be appropriately set.

Incidentally, although the holding member 70 has the communicating hole 70*a* because it employs the same part as the intermediate members 7, 8 in this embodiment, the communicating hole is not needed necessarily and it may employ a part that can be fix the receiver tank 9 on the tank 3 of the condenser 3. Accordingly, in manufacturing process of the intermediate members 7, 8, using a member, which is obtained before the communicating hole, is formed enables them to be manufactured at low costs. The number and the setting positions of the holding members 70 may be appropriately set.

Therefore, the third embodiment can obtain the following advantages in addition to the operation and advantages similar to those of the first embodiment.

(6) The tank 3 of a heat exchanger (the condenser 1) and the receiver tank 9 are easily fixed by using the holding member 70 with the same configuration as those of the intermediate members 7, 8 in the state where they are properly positioned.

This can decrease an additional process executed after the brazing process and the number of kinds of the parts, and further it can improve vibration tolerance in addition to the operation and the advantages similar to those of the first embodiment, because the intermediate members 7, 8 and the holding member 70 employ the same shaped parts.

(7) The intermediate members 7, 8 and the holding member 70 are arranged on the line in the longitudinal direction of the receiver tank 9. This can improve an assembly process of the intermediate members 7,8 and the holding member 70.

(8) The intermediate members 7, 8 are provided on longitudinal-directional one end portion of the receiver tank 9, and the holding member 70 is provided on the longitudinal-directional other end portion of the receiver tank 9. This can fix and support the receiver tank 9 on the condenser 1 in a stable state.

The Fourth Embodiment

Hereinafter, a fourth embodiment will be described.

In the fourth embodiment, construction members similar to those of the first embodiment are indicated by the same reference numbers, their explanations being omitted, and only different members will be described in detail.

Figure 27:
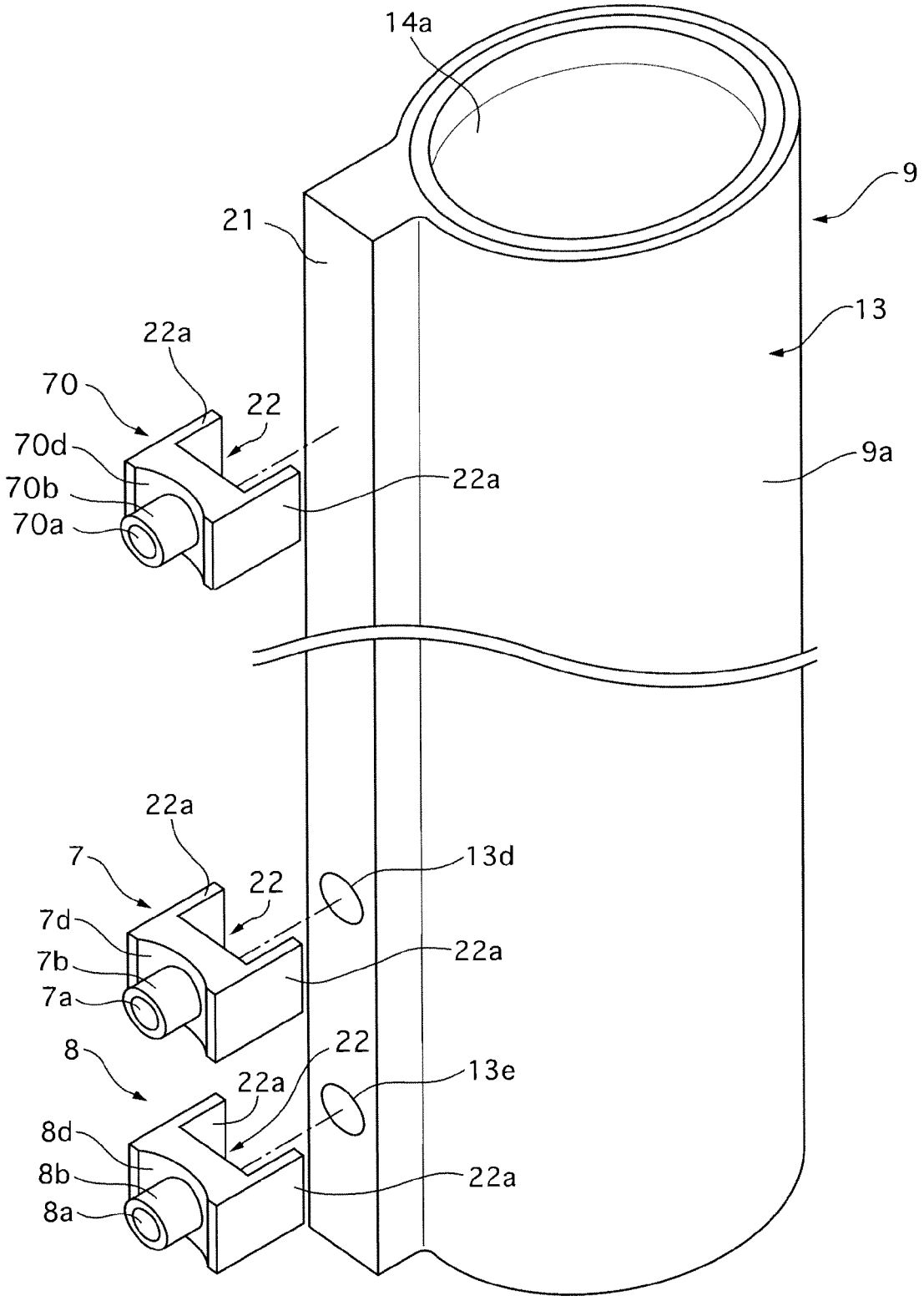
FIG. 27 is an exploded perspective view of a receiver tank, intermediate members, and a holding member that are used in a fourth embodiment.
Figure 28:
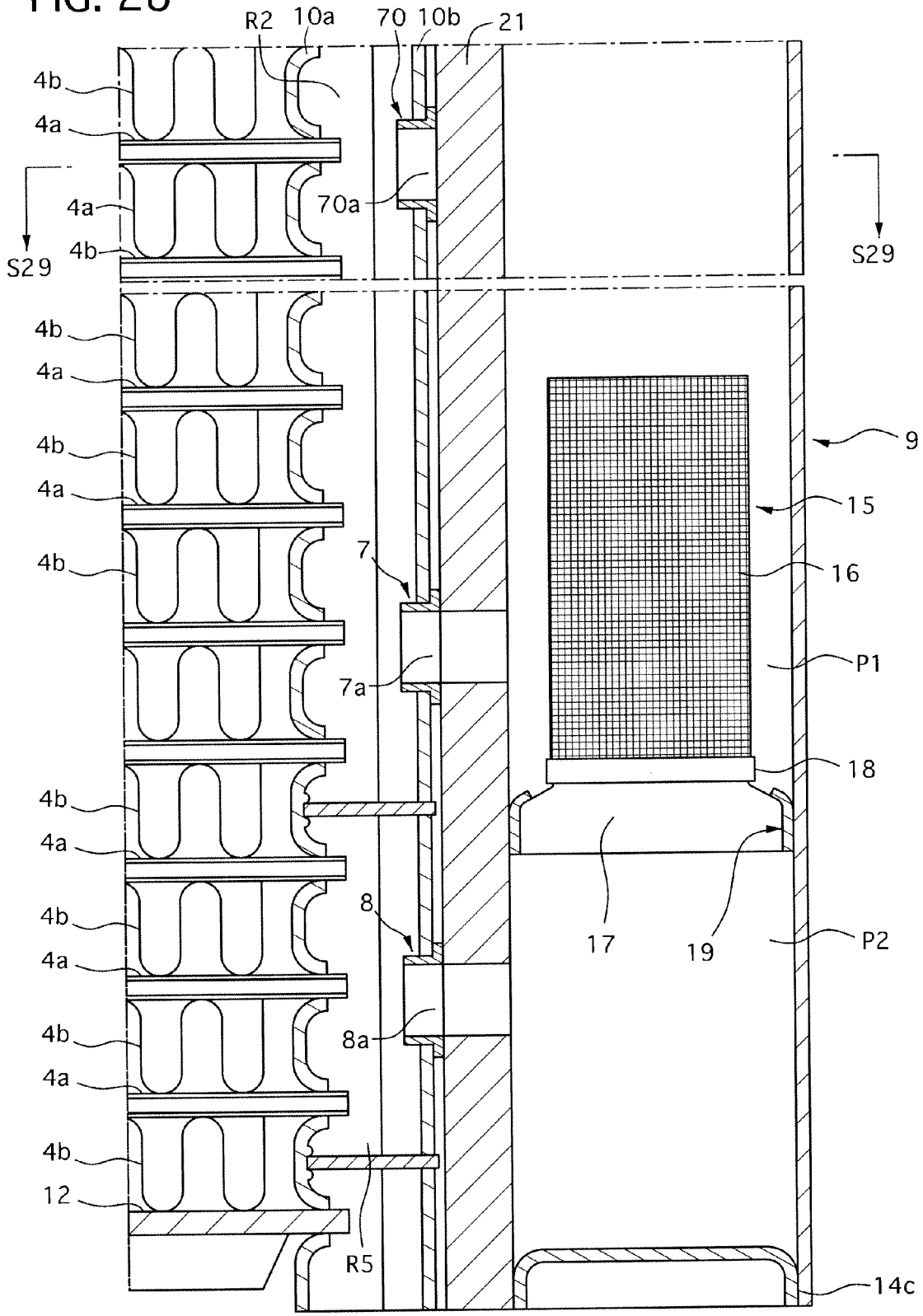
FIG. 28 is a cross sectional view of the receiver tank, the intermediate members, and the holding member that are used in the fourth embodiment.
Figure 29:
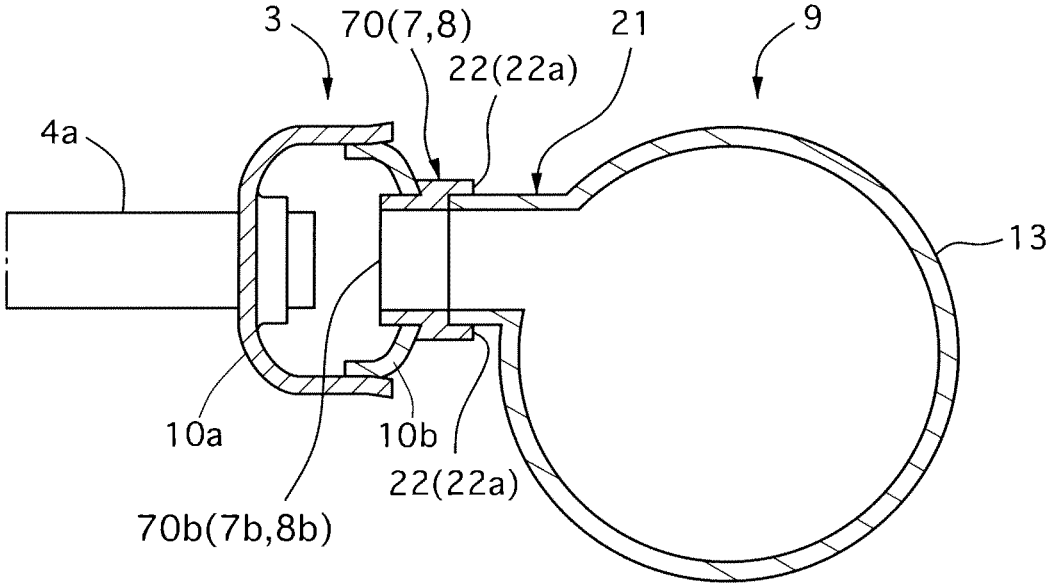
FIG. 29 is a cross sectional view taken along the line S29-S29 in FIG. 28.

FIG. 27 is an exploded perspective view explaining a fixation construction of a receiver tank, intermediate members and a holding member that are used in the fourth embodiment, FIG. 28 is an exploded view showing a fixation construction of the receiver tank, the intermediate members and the holding member, and FIG. 29 is a cross sectional view taken along the line S29-S29 in FIG. 24.

In the fourth embodiment, intermediate members 7, 8 are formed to have the configuration similar to those of the second embodiment, and a holding member 70 is formed to have the configuration similar to those of the intermediate members 7, 8. In addition, a fixing portion is provided at an intermediate member (7, 8) side and a holding member (70) side similarly to those of the second embodiment.

Specifically, as shown in FIG. 27, in the fourth embodiment, a connecting portion 21 is formed over the entire length of a receiver tank 9 to project toward a tank 3 of a condenser 1 in a rectangular shape on an outer circumferential portion of the receiver tank 9. On the other hand, fixing portions 22 are formed on a connecting portion side of the intermediate members 7, 8 and a holding member 70, having a cross section shaped like a U-letter to open toward the receiver tank 9.

Further, as shown in FIG. 28 and FIG. 29, the facing both side walls 22*a*, 22*a* of the U-letter shaped cross section of each fixing portion 22 of the intermediate members 7, 8 and the holding member 70 are bent toward the inner side of the connecting portion 21 of the receiver tank 9 to be fixed by caulking, so that they can be fixed by brazing in a state where they are temporally assembled.

Incidentally, in the fourth embodiment, the holding member 70 does not need necessarily the communicating hole 70*a*.

Figure 30:
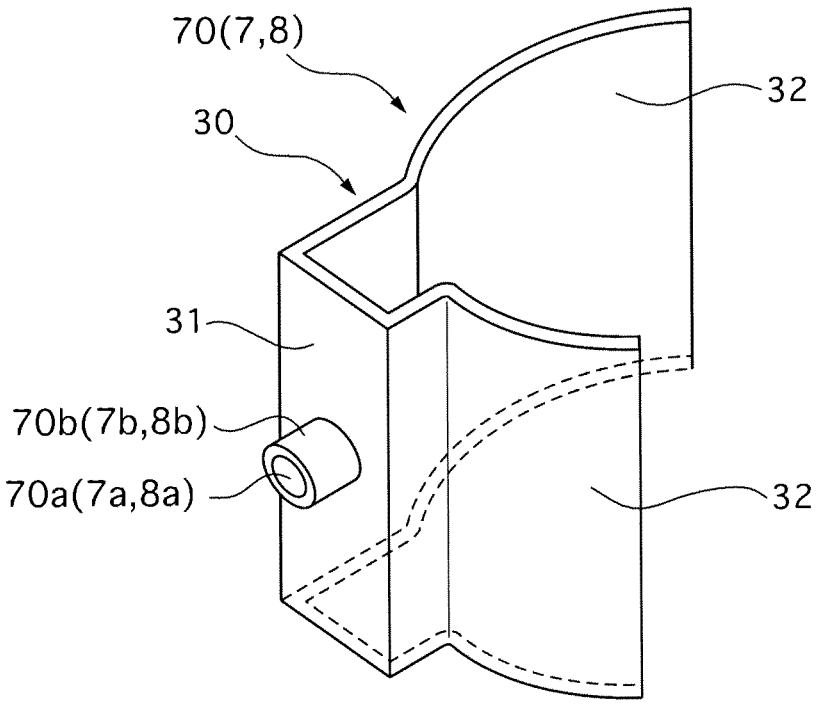
FIG. 30 is a perspective view of a holding member that is used for a modified example of the fourth embodiment.

In addition, similarly to a modified example of the second embodiment, the holding member 70 may be a fitting part 30, which is shaped like a half circular cylinder, including fixing portions 31, 32 as shown in FIG. 30, instead of the configuration shown in FIG. 27. The fixing portion 31 is formed to have a cross section shaped like a U-letter to open, and the fixing portions 32 are formed to have a curved surface that extends from the facing both side walls of the U-letter shaped cross section to be fittable to a portion of the outer circumferential portion 9*a*.

Figure 31:
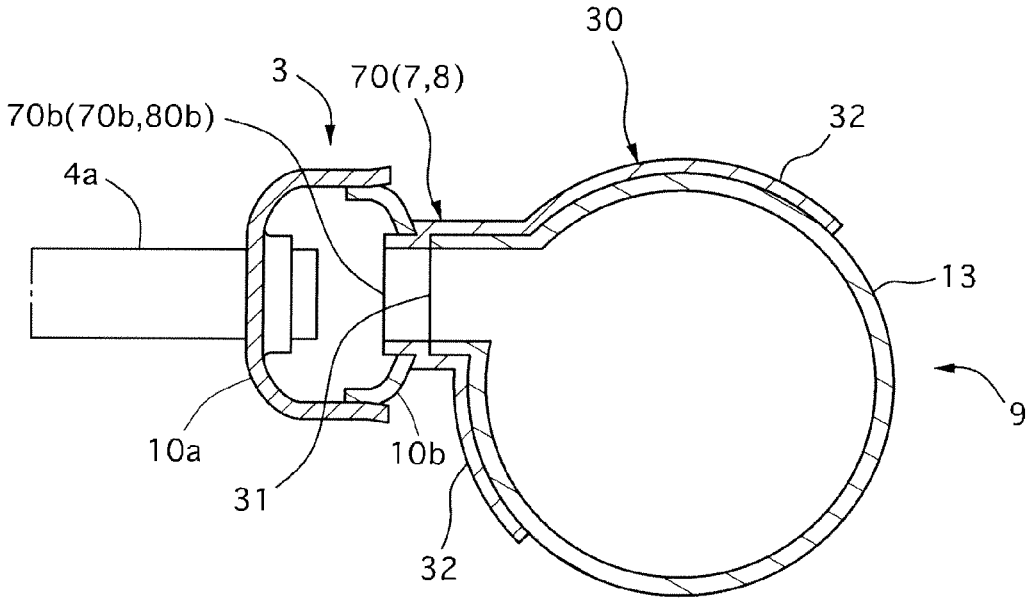
FIG. 31 is a cross sectional view showing a fixing construction of the holding member and a receiver tank of the fourth embodiment.

Further, as shown in FIG. 31, the receiver tank 9 is fixed by brazing on the tank 3 of the condenser 1 through holding member 70.

Accordingly, the fourth embodiment can obtain the operation and the advantages similar to those of the first to third embodiments.

Hereinbefore, while the embodiments have been described, the present invention is not limited to the above-described embodiments, and a design change and others are contained in the present invention as long as they do not depart from the scope of the present invention.

Although the restricting portion 13*c* and the both side walls 13*b* of the receiver tank 9, the intermediate members 7, 8 and the both side walls 22*a* of the holding member 70 are formed to extend in the vertical direction, it may extend horizontally. In this case, they need to be provided at an upward position and a downward position of each attachment position of the intermediate members 7, 8 and the holding member 70, respectively.

Further, in the modified examples of the second and fourth embodiments, a portion of the intermediate members 7, 8 may extend in the longitudinal direction to function as an air guide.

Incidentally, the order of assembling the intermediate members 7, 8, the holding member 70, the receiver tank 9 and the condenser 1 does not need necessarily to be performed in the order of the embodiments. For example, the intermediate members 7, 8 and the holding member 70 may be inserted and arranged in the restricting portion 13*c* to be caulked by using the both side walls 13*a*, and then the intermediate members 7, 8 and the inserting portions 7*a*, 8*a* and 70*a* of the holding member 70 may be inserted into and fixed to the communicating holes 10*k*, 10*m* and 10*n*. In this case, the inner diameters of the communicating holes 10*k*, 10*m* and 10*n* may be formed larger than the outer diameters of the inserting portions 7*a*, 8*a* and 70*a*. After inserted, they may be brazed in a state where gaps therebetween are filled by the brazing filler material or other material. Alternatively, caulking force described above may be slightly loosened so that a displacement between the communicating holes 10*k*, 10*m*, 10*n* and the inserting portion 7*a*, 8*a*, 70*a* can be adjusted, respectively. After positioned, they may be caulked tightly or they may be brazed by using the brazing filler material or other material.

Figure 32:
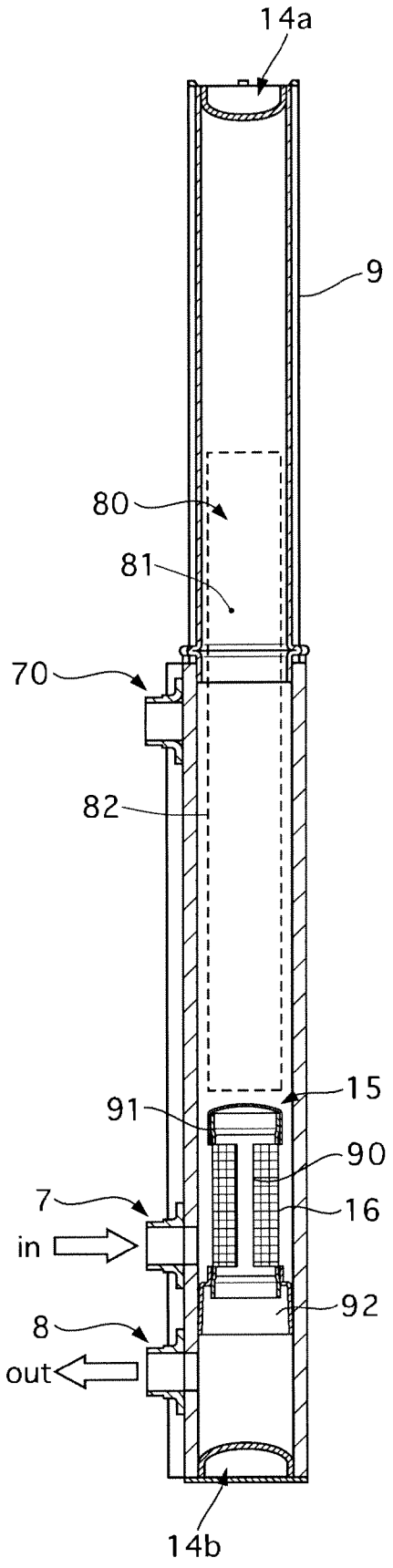
FIG. 32 is a cross sectional view showing a receiver tank of the first to fourth embodiments and modified examples thereof, a metallic filter of another example and a drying agent, which are contained in an interior of the receiver tank.

Incidentally, as shown in FIGS. 8, 17, 22 and 29, the metallic filter 15 shown in FIGS. 10-14 is contained in the receiver tank 9, which is not limited. That is, as shown in FIG. 32, the metallic filter 15, which is constructed as later described, is placed in the lower interior of the receiver tank 9, and the drying part 80 is placed in the upper interior thereof. The drying part 80 is used for removing water in the cooling medium that circulates in an air conditioning system. The drying part 80 includes a drying agent 81 and a drying-agent holding member 82 that is shaped like a bag made of felt, whose material is PET resin and others, and containing the drying agent 81, and the drying part 80 is held inside the receiver tank 9.

The drying agent 81 and the drying-agent holding member 82 move in the receiver tank 9 due to the movement of the cooling medium that circulates in the air conditioning system and dynamic change in inner pressure in the receiver tank 9 (arising from start, stop and others of a vehicle). In this case, the bag frays due to contact and wear of an upper portion of a net of the filter 15 and a lower portion of the bag as the drying-agent holding member 82.

Figure 33:
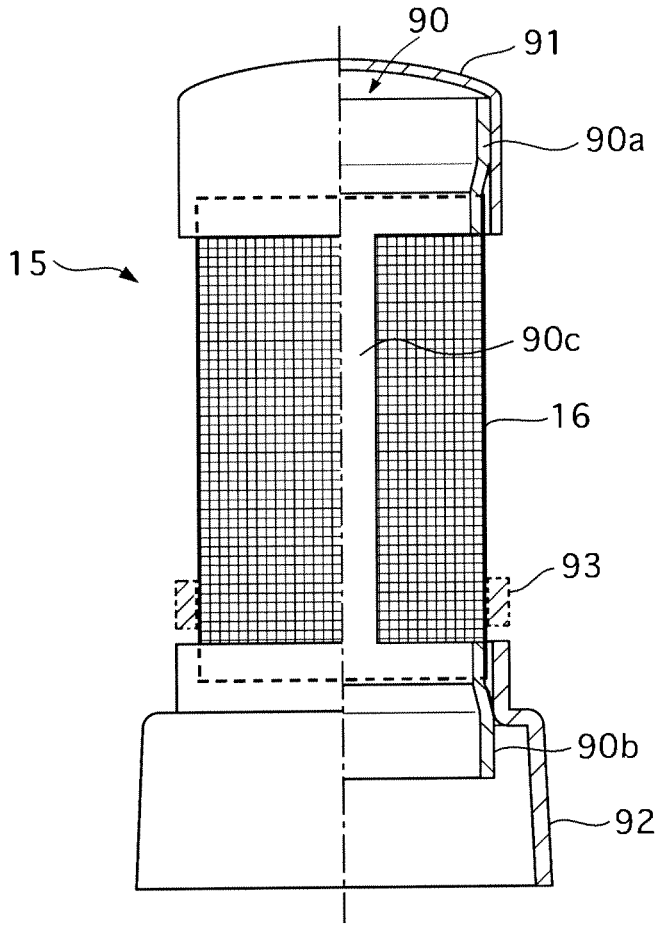
FIG. 33 is an enlarged front view of the metallic filter shown in FIG. 32.

In addition, as shown in FIG. 33, in a case where the metallic filter 15, which is one that removes contaminations included the cooling medium, uses a fine net in order to improve capacity to remove the contaminations. When the diameter of a wire of the net member becomes thinner, the strength of the entire filter remarkably decreases. As a result, the filter 15 crushes due to the weights of the drying agent 81 and the drying-agent holding member 82. In order to solve this problem, the metallic filter 15 is constructed as follows.

The metallic filter 15 includes a filter main body 16 including a net, a circular cylindrical frame 90 arranged in the filter main body 16, a cap 91 putted on an upper end portion of the frame 90, and a flange 92 holding a lower portion of the frame 90. The frame 90 is made of aluminum or the like, and it is formed by a circular cylinder configuration whose side surface portions are partially cut off except an upper end portion 90*a* shaped like a ring, a lower end portion shaped like a ring, and connecting portions 90*c* that connect two portions on those rings that are symmetrically positioned. The cap 91 is provided as above, the metallic filter 15 can be prevented from a crash due to the weights of the drying agent 81 and the drying-agent holding member 82 even when the reticulation of the filter main body 15 is set to be narrow.

Figure 34:
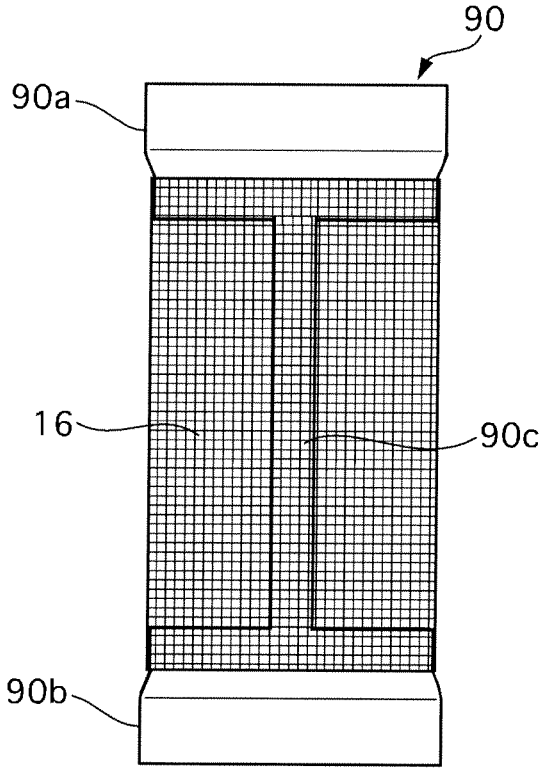
FIG. 34 is a side view showing a filter main body and a frame of the metallic filter shown in FIG. 32.

On the other hand, the diameters of the upper end portion 90*a* and the lower end portion 90*b* of the frame 90 are enlarged at the respective end portion sides, and the net of the filter main body 16 is fitted and fixed to the outer circumferential surfaces of a small diameter portion that exists at a center side therebetween, respectively. That is, as shown in FIG. 34, the metallic filter 15 is constructed in such a way that the filter main body 16, being a net like a plate, is wound like a circular cylinder around the outer circumference of the circular cylindrical frame 90 so that the side end portions of the filter main body 16 confront to each other or they are overlapped, and then they are partially or entirely connected by using a heating and melting means such as welding and brazing at the connecting portions 90*c* of the frame 90, or by using a pressing means such as pressure welding and pressure bonding.

The cap 91 may be made of aluminum material, and it is fitted to the upper end portion 90*a* to cover this portion and the upper end side portion of the net so that the lower portion of the bag (the drying-agent holding member 82) and the upper end portion of the net do not contact with each other, thereby preventing fray of the bag. In addition, the flange 92, which is made of aluminum material, is fitted to the lower end portion 90*b* so that the metallic filter 15 are held in the receiver 9.

Incidentally, in this case, similarly to the case of the metallic ring 18 shown in FIG. 13, the metallic ring 93 and the lower end portion 90*b* of the frame 90, which is extended up to the position facing the ring 93, may sandwich the lower end portion of the filter main body 16 in order to improve their sealing performance and prevent from dropping down of the filter main body 16 from the frame 90.

The invention claimed is:

1. A heat exchanger with a receiver tank, wherein a tank of the heat exchanger and the receiver tank are connected with each other through an intermediate member that communicates the tank of the heat exchanger and the receiver tank, wherein at least one of the intermediate member and an outer circumferential portion of the receiver tank is provided with a restricting portion that restricts a relative displacement between the intermediate member and the receiver tank at the outer circumferential portion of the receiver tank in a direction along an attachment surface of the receiver tank to which at least the intermediate member is attached, wherein the intermediate member comprises an inserting portion that projects at a tank side and is communicatably connected to the tank of the heat exchanger, and comprises a flat and nearly rectangular contact portion which has contact with the receiver tank at a receiver tank side, wherein a central axis of the intermediate member is offset in a lateral direction from a central axis of the receiver tank, wherein the intermediate member is adjacent to the receiver tank in the lateral direction without projecting into the receiver tank, and wherein the restricting portion and the intermediate member are between side surfaces of the receiver tank and the tank of the heat exchanger.

2. The heat exchanger with the receiver tank according to claim 1, wherein the restricting portion restricts the relative displacement between the intermediate member and the receiver tank in a direction vertical to the attachment surface.

3. The heat exchanger with the receiver tank according to claim 2, wherein the restricting portion is provided over the entire length of the receiver tank.

4. The heat exchanger with the receiver tank according to claim 3, wherein the restricting portion extends in a longitudinal direction of the receiver tank, and wherein the restricting portion has a U-shaped cross section and is configured to guide the other of the outer circumferential portion of the receiver tank and the intermediate member.

5. The heat exchanger with the receiver tank according to claim 4, wherein the restricting portion has facing side walls that guide the other of the outer circumferential portion of the receiver tank and the intermediate member, and wherein the restricting portion has a caulking portion that fixes the outer circumferential portion of the receiver tank and the intermediate member by caulking.

6. The heat exchanger with the receiver tank according to claim 5, further comprising a holding member which is arranged between the receiver tank and the tank of the heat exchanger to fix and support the receiver tank to the tank, the holding member employing the same shaped part as the intermediate member.

7. The heat exchanger with the receiver tank according to claim 6, wherein the restricting portion extends in a longitudinal direction of the receiver tank on the outer circumferential portion of the receiver tank, wherein the facing side walls guide the intermediate member and the holding member, and wherein the restricting portion has a caulking portion that fixes the intermediate member and the holding member by caulking.

8. The heat exchanger with the receiver tank according to claim 7, wherein the intermediate member is provided on one end portion in a longitudinal direction of the receiver tank, and wherein the holding member is provided on the other end portion in the longitudinal direction of the receiver tank.

9. The heat exchanger with the receiver tank according to claim 8, wherein the intermediate member and the holding member are arranged on a line in a longitudinal direction of the receiver tank.

10. The heat exchanger with the receiver tank according to claim 2, further comprising a holding member which is arranged between the receiver tank and the tank of the heat exchanger to fix and support the receiver tank to the tank, the holding member employing the same shaped part as the intermediate member.

11. The heat exchanger with the receiver tank according to claim 1, wherein the restricting portion is provided over the entire length of the receiver tank.

12. The heat exchanger with the receiver tank according to claim 11, wherein the restricting portion extends in a longitudinal direction of the receiver tank, and wherein the restricting portion has a U-shaped cross section and is configured to guide the other of the outer circumferential portion of the receiver tank and the intermediate member.

13. The heat exchanger with the receiver tank according to claim 11, further comprising a holding member which is arranged between the receiver tank and the tank of the heat exchanger to fix and support the receiver tank to the tank, the holding member employing the same shaped part as the intermediate member.

14. The heat exchanger with the receiver tank according to claim 1, wherein the restricting portion extends in a longitudinal direction of the receiver tank, and wherein the restricting portion has a U-shaped cross section and is configured to guide the other of the outer circumferential portion of the receiver tank and the intermediate member.

15. The heat exchanger with the receiver tank according to claim 14, wherein the restricting portion has facing side walls configured to guide the other of the outer circumferential portion of the receiver tank and the intermediate member, and wherein the restricting portion has a caulking portion that fixes the outer circumferential portion of the receiver tank and the intermediate member by caulking.

16. The heat exchanger with the receiver tank according to claim 14, further comprising a holding member which is arranged between the receiver tank and the tank of the heat exchanger to fix and support the receiver tank to the tank, the holding member employing the same shaped part as the intermediate member.

17. The heat exchanger with the receiver tank according to claim 1, further comprising a holding member which is arranged between the receiver tank and the tank of the heat exchanger to fix and support the receiver tank to the tank, the holding member employing the same shaped part as the intermediate member.

18. The heat exchanger with the receiver tank according to claim 17, wherein the restricting portion has a U-shaped cross section that extends in a longitudinal direction of the receiver tank on the outer circumferential portion of the receiver tank, wherein facing side walls of the restricting portion guide the intermediate member and the holding member, and wherein the restricting portion has a caulking portion that fixes the intermediate member and the holding member by caulking.

19. The heat exchanger with the receiver tank according to claim 17, wherein the intermediate member is provided on one end portion in a longitudinal direction of the receiver tank, and wherein the holding member is provided on the other end portion in the longitudinal direction of the receiver tank.

20. The heat exchanger with the receiver tank according to claim 17, wherein the intermediate member and the holding member are arranged on a line in a longitudinal direction of the receiver tank.

* * * * *